US011898223B2

(12) United States Patent
Sherman et al.

(10) Patent No.: US 11,898,223 B2
(45) **Date of Patent: *Feb. 13, 2024**

(54) DEGRADABLE METAL MATRIX COMPOSITE

(71) Applicant: Terves Inc., Euclid, OH (US)

(72) Inventors: Andrew J. Sherman, Mentor, OH (US); Nicholas Farkas, Euclid, OH (US); David Wolf, Euclid, OH (US)

(73) Assignee: Terves, LLC, Euclid, OH (US)

( * ) Notice: Subject to any disclaimer, the term of this patent is extended or adjusted under 35 U.S.C. 154(b) by 586 days.

This patent is subject to a terminal disclaimer.

(21) Appl. No.: 17/018,547

(22) Filed: Sep. 11, 2020

(65) Prior Publication Data

US 2020/0407822 A1 Dec. 31, 2020

Related U.S. Application Data

(63) Continuation of application No. 16/045,924, filed on Jul. 26, 2018.

(Continued)

(51) Int. Cl.
*C22C 1/10* (2023.01)
*C22C 29/02* (2006.01)

(Continued)

(52) U.S. Cl.
CPC ..... *C22C 1/1068* (2013.01); *C22C 1/047* (2023.01); *C22C 1/101* (2013.01); *C22C 1/1036* (2013.01); *C22C 21/00* (2013.01); *C22C 23/00* (2013.01); *C22C 29/02* (2013.01); *C22C 29/06* (2013.01); *C22C 29/12* (2013.01); *C22C 29/14* (2013.01); *C22C 29/16* (2013.01); *C22C 29/18* (2013.01); *C22C 32/0036* (2013.01); *C22C 32/0052* (2013.01); *C22C 32/0057* (2013.01); *C22C 32/0063* (2013.01); *C22C 32/0068* (2013.01);

(Continued)

(58) Field of Classification Search
CPC ..... C22C 1/1068
See application file for complete search history.

(56) References Cited

U.S. PATENT DOCUMENTS 1,468,905 A 7/1923 Herman
1,558,066 A 10/1925 Veazey et al.

(Continued)

FOREIGN PATENT DOCUMENTS

CA 2783241 6/2011
CA 2783346 6/2011

(Continued)

OTHER PUBLICATIONS

Scharf et al., "Corrosion of AX 91 Secondary Magnesium Alloy", Advanced Engineering Materials, vol. 7, No. 12, pp. 1134-1142 (2005).

(Continued)

*Primary Examiner* — Christopher S Kessler
(74) *Attorney, Agent, or Firm* — Ulmer & Berne LLP; Brian E. Turung

(57) ABSTRACT

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations.

13 Claims, 6 Drawing Sheets

Related U.S. Application Data

(60) Provisional application No. 62/537,707, filed on Jul. 27, 2017.

(51) Int. Cl.

| | |
|---|---|
| ***C22C 47/04*** | (2006.01) |
| ***C22C 32/00*** | (2006.01) |
| ***C22C 23/00*** | (2006.01) |
| ***C22C 21/00*** | (2006.01) |
| ***C22C 29/06*** | (2006.01) |
| ***C22C 29/18*** | (2006.01) |
| ***C22C 49/04*** | (2006.01) |
| ***C22C 29/16*** | (2006.01) |
| ***C22C 47/12*** | (2006.01) |
| ***C22C 29/14*** | (2006.01) |
| ***C22C 29/12*** | (2006.01) |
| ***C22C 1/047*** | (2023.01) |

(52) U.S. Cl.

CPC ..... *C22C 32/0073* (2013.01); *C22C 32/0078* (2013.01); *C22C 47/04* (2013.01); *C22C 47/12* (2013.01); *C22C 49/04* (2013.01); *C22C 1/1073* (2023.01)

(56) References Cited

U.S. PATENT DOCUMENTS 1,880,614 A 10/1932 Wetherill et al.
2,352,993 A 7/1933 Albertson
2,011,613 A 8/1935 Brown et al.
2,094,578 A 10/1937 Blumenthal et al.
2,189,697 A 2/1940 Baker
2,222,233 A 11/1940 Mize
2,225,143 A 12/1940 Baker et al.
2,238,895 A 4/1941 Gage
2,261,292 A 11/1941 Salnikov
2,294,648 A 9/1942 Ansel et al.
2,301,624 A 11/1942 Holt
2,394,843 A 2/1946 Cook et al.
2,672,199 A 3/1954 McKenna
2,753,941 A 7/1956 Hebard et al.
2,754,910 A 7/1956 Derrick et al.
2,933,136 A 4/1960 Ayers et al.
2,983,634 A 5/1961 Budininkas et al.
3,057,405 A 10/1962 Mallinger
3,066,391 A 12/1962 Vordahl et al.
3,106,959 A 10/1963 Huitt et al.
3,142,338 A 7/1964 Brown
3,152,009 A 10/1964 DeLong
3,180,728 A 4/1965 Pryor et al.
3,180,778 A 4/1965 Rinderspacher et al.
3,196,949 A 7/1965 Thomas
3,226,314 A 12/1965 Wellington et al.
3,242,988 A 3/1966 McGuire, Jr. et al.
3,295,935 A 1/1967 Pflumm et al.
3,298,440 A 1/1967 Current
3,316,748 A 5/1967 Lang et al.
3,326,291 A 6/1967 Zandemer
3,347,714 A 10/1967 Broverman et al.
3,385,696 A 5/1968 Hitchcock et al.
3,390,724 A 7/1968 Caldwell
3,395,758 A 8/1968 Kelly et al.
3,406,101 A 10/1968 Kilpatrick
3,416,918 A 12/1968 Roberts
3,434,539 A 3/1969 Merritt
3,445,148 A 5/1969 Harris et al.
3,445,731 A 5/1969 Saeki et al.
3,465,181 A 9/1969 Colby et al.
3,489,218 A 1/1970 Means
3,513,230 A 5/1970 Rhees et al.
3,600,163 A 8/1971 Badia et al.
3,602,305 A 8/1971 Kisling
3,637,446 A 1/1972 Elliott et al.
3,645,331 A 2/1972 Maurer et al.
3,660,049 A 5/1972 Benjamin
3,765,484 A 10/1973 Hamby, Jr. et al.
3,768,563 A 10/1973 Blount
3,775,823 A 12/1973 Adolph et al.
3,816,080 A 6/1974 Bomford et al.
3,823,045 A 7/1974 Hielema
3,878,889 A 4/1975 Seabourne
3,894,850 A 7/1975 Kovalchuk et al.
3,924,677 A 12/1975 Prenner et al.
3,957,483 A 5/1976 Suzuki
4,010,583 A 3/1977 Highberg
4,039,717 A 8/1977 Titus
4,050,529 A 9/1977 Tagirov et al.
4,157,732 A 6/1979 Fonner
4,248,307 A 2/1981 Silberman et al.
4,264,362 A 4/1981 Serveg et al.
4,284,137 A 8/1981 Taylor
4,292,377 A 9/1981 Petersen et al.
4,368,788 A 1/1983 Drake
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,450,136 A 5/1984 Dudek et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,524,825 A 6/1985 Fore
4,526,840 A 7/1985 Jerabek
4,534,414 A 8/1985 Pringle
4,539,175 A 9/1985 Lichti et al.
4,554,986 A 11/1985 Jones
4,619,699 A 10/1986 Petkovic-Luton et al.
4,640,354 A 2/1987 Boisson
4,648,901 A 3/1987 Murray et al.
4,655,852 A 4/1987 Rallis
4,664,962 A 5/1987 DesMarais, Jr.
4,668,470 A 5/1987 Gilman et al.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,690,796 A 9/1987 Paliwal
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,719,971 A 1/1988 Owens
4,721,159 A 1/1988 Ohkochi et al.
4,738,599 A 4/1988 Shilling
4,741,973 A 5/1988 Condit et al.
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,853,056 A 8/1989 Hoffman
4,869,324 A 9/1989 Holder
4,869,325 A 9/1989 Halbardier
4,875,948 A 10/1989 Vernecker
4,880,059 A 11/1989 Brandell et al.
4,889,187 A 12/1989 Terrell et al.
4,890,675 A 1/1990 Dew
4,901,794 A 2/1990 Baugh et al.
4,909,320 A 3/1990 Hebert et al.

(56) References Cited

U.S. PATENT DOCUMENTS 4,916,029 A 4/1990 Nagle et al.
4,917,966 A 4/1990 Wilde et al.
4,921,664 A 5/1990 Couper
4,929,415 A 5/1990 Okazaki
4,932,474 A 6/1990 Schroeder, Jr. et al.
4,934,459 A 6/1990 Baugh et al.
4,938,309 A 7/1990 Emdy
4,938,809 A 7/1990 Das et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Muuller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,106,702 A 4/1992 Walker et al.
5,117,915 A 6/1992 Mueller et al.
5,143,795 A 9/1992 Das et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,238,646 A 8/1993 Tarcy et al.
5,240,495 A 8/1993 Dieckmann et al.
5,240,742 A 8/1993 Johnson et al.
5,252,365 A 10/1993 White
5,253,714 A 10/1993 Davis et al.
5,271,468 A 12/1993 Streich et al.
5,273,569 A 12/1993 Gilman et al.
5,282,509 A 2/1994 Schurr, III
5,285,798 A 2/1994 Banerjee et al.
5,292,478 A 3/1994 Scorey
5,293,940 A 3/1994 Hromas et al.
5,304,260 A 4/1994 Aikawa et al.
5,304,588 A 4/1994 Boysen et al.
5,309,874 A 5/1994 Willermet et al.
5,310,000 A 5/1994 Arterbury et al.
5,316,598 A 5/1994 Chang et al.
5,318,746 A 6/1994 Lashmore et al.
5,336,466 A 8/1994 Iba
5,342,576 A 8/1994 Whitehead
5,352,522 A 10/1994 Kugimiya et al.
5,380,473 A 1/1995 Bogue et al.
5,387,380 A 2/1995 Cima et al.
5,392,860 A 2/1995 Ross
5,394,236 A 2/1995 Murnick
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy
5,474,131 A 12/1995 Jordan, Jr. et al.
5,476,632 A 12/1995 Shivanath et al.
5,477,923 A 12/1995 Jordan, Jr. et al.
5,479,986 A 1/1996 Gano et al.
5,494,538 A 2/1996 Kirillov et al.
5,506,055 A 4/1996 Dorfman et al.
5,507,439 A 4/1996 Story
5,511,620 A 4/1996 Baugh et al.
5,524,699 A 6/1996 Cook
5,526,880 A 6/1996 Jordan, Jr. et al.
5,526,881 A 6/1996 Martin et al.
5,529,746 A 6/1996 Knoss et al.
5,531,735 A 7/1996 Thompson
5,533,573 A 7/1996 Jordan, Jr. et al.
5,536,485 A 7/1996 Kume et al.
5,552,110 A 9/1996 Iba
5,558,153 A 9/1996 Holcombe et al.
5,601,924 A 2/1997 Beane et al.
5,607,017 A 3/1997 Owens et al.
5,623,993 A 4/1997 Van Buskirk et al.
5,623,994 A 4/1997 Robinson
5,641,023 A 6/1997 Ross et al.
5,636,691 A 7/1997 Hendrickson et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,722,033 A 2/1998 Carden
5,728,195 A 3/1998 Eastman et al.
5,765,639 A 6/1998 Muth
5,767,562 A 6/1998 Yamashita
5,772,735 A 6/1998 Sehgal et al.
5,782,305 A 7/1998 Hicks
5,797,454 A 8/1998 Hipp
5,820,608 A 10/1998 Luzio et al.
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,941,309 A 8/1999 Appleton
5,960,881 A 10/1999 Allamon et al.
5,964,965 A 10/1999 Schulz et al.
5,894,007 A 11/1999 Yuan et al.
5,980,602 A 11/1999 Carden
5,985,466 A 11/1999 Atarashi et al.
5,988,287 A 11/1999 Jordan, Jr. et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,030,637 A 2/2000 Whitehead
6,032,735 A 3/2000 Echols
6,033,622 A 3/2000 Maruyama
6,036,777 A 3/2000 Sachs
6,036,792 A 3/2000 Chu et al.
6,040,087 A 3/2000 Kawakami
6,047,773 A 4/2000 Zeltmann et al.
6,050,340 A 4/2000 Scott
6,069,313 A 5/2000 Kay

(56) References Cited

U.S. PATENT DOCUMENTS

| | | | |
|---|---|---|---|
| 6,076,600 | A | 6/2000 | Vick, Jr. et al. |
| 6,079,496 | A | 6/2000 | Hirth |
| 6,085,837 | A | 7/2000 | Massinon et al. |
| 6,095,247 | A | 8/2000 | Streich et al. |
| 6,119,783 | A | 9/2000 | Parker et al. |
| 6,126,898 | A | 10/2000 | Butler |
| 6,142,237 | A | 11/2000 | Christmas et al. |
| 6,161,622 | A | 12/2000 | Robb et al. |
| 6,167,970 | B1 | 1/2001 | Stout et al. |
| 6,170,583 | B1 | 1/2001 | Boyce |
| 6,171,359 | B1 | 1/2001 | Levinski et al. |
| 6,173,779 | B1 | 1/2001 | Smith |
| 6,176,323 | B1 | 1/2001 | Weirich et al. |
| 6,189,616 | B1 | 2/2001 | Gano et al. |
| 6,189,618 | B1 | 2/2001 | Beeman et al. |
| 6,213,202 | B1 | 4/2001 | Read, Jr. |
| 6,220,349 | B1 | 4/2001 | Vargus et al. |
| 6,220,350 | B1 | 4/2001 | Brothers et al. |
| 6,220,357 | B1 | 4/2001 | Carmichael et al. |
| 6,228,904 | B1 | 5/2001 | Yadav et al. |
| 6,230,799 | B1 | 5/2001 | Slaughter et al. |
| 6,237,688 | B1 | 5/2001 | Burleson et al. |
| 6,238,280 | B1 | 5/2001 | Ritt et al. |
| 6,241,021 | B1 | 6/2001 | Bowling |
| 6,248,399 | B1 | 6/2001 | Hehmann |
| 6,250,392 | B1 | 6/2001 | Muth |
| 6,261,432 | B1 | 7/2001 | Huber et al. |
| 6,265,205 | B1 | 7/2001 | Hitchens et al. |
| 6,273,187 | B1 | 8/2001 | Voisin, Jr. et al. |
| 6,276,452 | B1 | 8/2001 | Davis et al. |
| 6,276,457 | B1 | 8/2001 | Moffatt et al. |
| 6,279,656 | B1 | 8/2001 | Sinclair et al. |
| 6,287,332 | B1 | 9/2001 | Bolz et al. |
| 6,287,445 | B1 | 9/2001 | Lashmore et al. |
| 6,302,205 | B1 | 10/2001 | Ryll |
| 6,315,041 | B1 | 11/2001 | Carlisle et al. |
| 6,315,050 | B2 | 11/2001 | Vaylnshteyn et al. |
| 6,325,148 | B1 | 12/2001 | Trahan et al. |
| 6,328,110 | B1 | 12/2001 | Joubert |
| 6,341,653 | B1 | 1/2002 | Fermaniuk et al. |
| 6,341,747 | B1 | 1/2002 | Schmidt et al. |
| 6,349,766 | B1 | 2/2002 | Bussear et al. |
| 6,354,372 | B1 | 3/2002 | Carisell et al. |
| 6,354,379 | B2 | 3/2002 | Miszewski et al. |
| 6,371,206 | B1 | 4/2002 | Mills |
| 6,372,346 | B1 | 4/2002 | Toth |
| 6,382,244 | B2 | 5/2002 | Vann |
| 6,390,195 | B1 | 5/2002 | Nguyen et al. |
| 6,390,200 | B1 | 5/2002 | Allamon et al. |
| 6,394,180 | B1 | 5/2002 | Berscheidt et al. |
| 6,394,185 | B1 | 5/2002 | Constien |
| 6,395,402 | B1 | 5/2002 | Lambert et al. |
| 6,397,950 | B1 | 6/2002 | Streich et al. |
| 6,401,547 | B1 | 6/2002 | Hatfield et al. |
| 6,403,210 | B1 | 6/2002 | Stuivinga et al. |
| 6,408,946 | B1 | 6/2002 | Marshall et al. |
| 6,419,023 | B1 | 7/2002 | George et al. |
| 6,422,314 | B1 | 7/2002 | Todd et al. |
| 6,439,313 | B1 | 8/2002 | Thomeer et al. |
| 6,444,316 | B1 | 9/2002 | Reddy et al. |
| 6,446,717 | B1 | 9/2002 | White et al. |
| 6,457,525 | B1 | 10/2002 | Scott |
| 6,467,546 | B2 | 10/2002 | Allamon et al. |
| 6,470,965 | B1 | 10/2002 | Winzer |
| 6,491,097 | B1 | 12/2002 | Oneal et al. |
| 6,491,116 | B2 | 12/2002 | Berscheidt et al. |
| 6,513,598 | B2 | 2/2003 | Moore et al. |
| 6,513,600 | B2 | 2/2003 | Ross |
| 6,527,051 | B1 | 3/2003 | Reddy et al. |
| 6,540,033 | B1 | 4/2003 | Sullivan et al. |
| 6,543,543 | B2 | 4/2003 | Muth |
| 6,554,071 | B1 | 4/2003 | Reddy et al. |
| 6,561,275 | B2 | 5/2003 | Glass et al. |
| 6,581,681 | B1 | 6/2003 | Zimmerman et al. |
| 6,588,507 | B2 | 7/2003 | Dusterhoft et al. |
| 6,591,915 | B2 | 7/2003 | Burris et al. |
| 6,601,648 | B2 | 8/2003 | Ebinger |
| 6,601,650 | B2 | 8/2003 | Sundararajan |
| 6,609,569 | B2 | 8/2003 | Towlett et al. |
| 6,612,826 | B1 | 9/2003 | Bauer et al. |
| 6,613,383 | B1 | 9/2003 | George et al. |
| 6,619,400 | B2 | 9/2003 | Brunet |
| 6,630,008 | B1 | 10/2003 | Meeks, III et al. |
| 6,634,428 | B2 | 10/2003 | Krauss et al. |
| 6,662,886 | B2 | 12/2003 | Russell |
| 6,675,889 | B1 | 1/2004 | Mullins et al. |
| 6,699,305 | B2 | 3/2004 | Myrick |
| 6,712,153 | B2 | 3/2004 | Turley et al. |
| 6,712,797 | B1 | 3/2004 | Southern, Jr. |
| 6,713,177 | B2 | 3/2004 | George et al. |
| 6,715,541 | B2 | 4/2004 | Pedersen et al. |
| 6,737,385 | B2 | 5/2004 | Todd et al. |
| 6,779,599 | B2 | 8/2004 | Mullins et al. |
| 6,799,638 | B2 | 10/2004 | Butterfield, Jr. |
| 6,810,960 | B2 | 11/2004 | Pia |
| 6,817,414 | B2 | 11/2004 | Lee |
| 6,831,044 | B2 | 12/2004 | Constien |
| 6,883,611 | B2 | 4/2005 | Smith et al. |
| 6,887,297 | B2 | 5/2005 | Winter et al. |
| 6,896,049 | B2 | 5/2005 | Moyes |
| 6,896,061 | B2 | 5/2005 | Hriscu et al. |
| 6,899,777 | B2 | 5/2005 | Vaidyanathan et al. |
| 6,908,516 | B2 | 6/2005 | Hehmann et al. |
| 6,913,827 | B2 | 7/2005 | Georget et al. |
| 6,926,086 | B2 | 8/2005 | Patterson et al. |
| 6,932,159 | B2 | 8/2005 | Hovem |
| 6,939,388 | B2 | 9/2005 | Angeliu |
| 6,945,331 | B2 | 9/2005 | Patel |
| 6,951,331 | B2 | 10/2005 | Haughom et al. |
| 6,959,759 | B2 | 11/2005 | Doane et al. |
| 6,973,970 | B2 | 12/2005 | Johnston et al. |
| 6,973,973 | B2 | 12/2005 | Howard et al. |
| 6,983,796 | B2 | 1/2006 | Bayne et al. |
| 6,986,390 | B2 | 1/2006 | Doane et al. |
| 7,013,989 | B2 | 3/2006 | Hammond et al. |
| 7,013,998 | B2 | 3/2006 | Ray et al. |
| 7,017,664 | B2 | 3/2006 | Walker et al. |
| 7,017,677 | B2 | 3/2006 | Keshavan et al. |
| 7,021,389 | B2 | 4/2006 | Bishop et al. |
| 7,025,146 | B2 | 4/2006 | King et al. |
| 7,028,778 | B2 | 4/2006 | Krywitsky |
| 7,044,230 | B2 | 5/2006 | Starr et al. |
| 7,048,812 | B2 | 5/2006 | Bettles et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,063,748 | B2 | 6/2006 | Talton |
| 7,090,027 | B1 | 8/2006 | Williams |
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,807 | B1 | 8/2006 | Meeks, III et al. |
| 7,097,906 | B2 | 8/2006 | Gardner |
| 7,108,080 | B2 | 9/2006 | Tessari et al. |
| 7,111,682 | B2 | 9/2006 | Blaisdell |
| 7,128,145 | B2 | 10/2006 | Mickey |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,165,622 | B2 | 1/2007 | Hirth et al. |
| 7,168,494 | B2 | 1/2007 | Starr et al. |
| 7,174,963 | B2 | 2/2007 | Bertelsen |
| 7,182,135 | B2 | 2/2007 | Szarka |
| 7,188,559 | B1 | 3/2007 | Vecchio |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |

(56) References Cited

U.S. PATENT DOCUMENTS

| | | | |
|---|---|---|---|
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,316,274 | B2 | 1/2008 | Xu et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,867 | B2 | 4/2008 | Carter et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,380,600 | B2 | 6/2008 | Willberg et al. |
| 7,384,443 | B2 | 6/2008 | Mirchandani |
| 7,387,158 | B2 | 6/2008 | Murray et al. |
| 7,387,165 | B2 | 6/2008 | Lopez de Cardenas et al. |
| 7,392,841 | B2 | 7/2008 | Murray et al. |
| 7,401,648 | B2 | 7/2008 | Richard |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,752 | B2 | 12/2008 | Dale et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,491,444 | B2 | 2/2009 | Smith et al. |
| 7,503,390 | B2 | 3/2009 | Gomez |
| 7,503,392 | B2 | 3/2009 | King et al. |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,516,791 | B2 | 4/2009 | Bryant et al. |
| 7,520,944 | B2 | 4/2009 | Johnson |
| 7,527,103 | B2 | 5/2009 | Huang et al. |
| 7,531,020 | B2 | 5/2009 | Woodfield et al. |
| 7,531,021 | B2 | 5/2009 | Woodfield et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,607,476 | B2 | 10/2009 | Tom et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,647,964 | B2 | 1/2010 | Akbar et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,700,038 | B2 | 4/2010 | Soran et al. |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,743,836 | B2 | 6/2010 | Cook et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,771,289 | B2 | 8/2010 | Palumbo et al. |
| 7,771,547 | B2 | 8/2010 | Bieler et al. |
| 7,775,284 | B2 | 8/2010 | Richard et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,793,820 | B2 | 9/2010 | Hirano et al. |
| 7,794,520 | B2 | 9/2010 | Murty et al. |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,851,016 | B2 | 12/2010 | Arbab et al. |
| 7,855,168 | B2 | 12/2010 | Fuller et al. |
| 7,861,779 | B2 | 1/2011 | Vestavik |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,879,162 | B2 | 2/2011 | Pandey |
| 7,879,367 | B2 | 2/2011 | Heublein et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clarke et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,918,275 | B2 | 4/2011 | Clem |
| 7,931,093 | B2 | 4/2011 | Foster et al. |
| 7,938,191 | B2 | 5/2011 | Vaidya |
| 7,946,335 | B2 | 5/2011 | Bewlay et al. |
| 7,946,340 | B2 | 5/2011 | Surjattmadja et al. |
| 7,958,940 | B2 | 6/2011 | Jameson |
| 7,963,331 | B2 | 6/2011 | Surjattmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 7,992,763 | B2 | 8/2011 | Vecchio et al. |
| 7,999,987 | B2 | 8/2011 | Dellinger et al. |
| 8,002,821 | B2 | 8/2011 | Stinson |
| 8,020,619 | B1 | 9/2011 | Robertson et al. |
| 8,020,620 | B2 | 9/2011 | Daniels et al. |
| 8,025,104 | B2 | 9/2011 | Cooke, Jr. |
| 8,028,767 | B2 | 10/2011 | Radford et al. |
| 8,033,331 | B2 | 10/2011 | Themig |
| 8,034,152 | B2 | 10/2011 | Westin et al. |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,114,148 | B2 | 2/2012 | Atanasoska et al. |
| 8,119,713 | B2 | 2/2012 | Dubois et al. |
| 8,127,856 | B1 | 3/2012 | Nish et al. |
| 8,153,052 | B2 | 4/2012 | Jackson et al. |
| 8,163,060 | B2 | 4/2012 | Manishi et al. |
| 8,167,043 | B2 | 5/2012 | Willberg et al. |
| 8,211,247 | B2 | 7/2012 | Marya et al. |
| 8,211,248 | B2 | 7/2012 | Marya |
| 8,211,331 | B2 | 7/2012 | Jorgensen et al. |

(56) References Cited

U.S. PATENT DOCUMENTS

| | | | |
|---|---|---|---|
| 8,220,554 | B2 | 7/2012 | Jordan et al. |
| 8,226,740 | B2 | 7/2012 | Chaumonnot et al. |
| 8,230,731 | B2 | 7/2012 | Dyer et al. |
| 8,231,947 | B2 | 7/2012 | Vaidya et al. |
| 8,263,178 | B2 | 9/2012 | Boulos et al. |
| 8,267,177 | B1 | 9/2012 | Vogel et al. |
| 8,276,670 | B2 | 10/2012 | Patel |
| 8,277,974 | B2 | 10/2012 | Kumar et al. |
| 8,297,364 | B2 | 10/2012 | Agrawal et al. |
| 8,327,931 | B2 | 12/2012 | Agrawal et al. |
| 8,403,037 | B2 | 3/2013 | Agrawal et al. |
| 8,413,727 | B2 | 4/2013 | Holmes |
| 8,425,651 | B2 | 4/2013 | Xu et al. |
| 8,459,347 | B2 | 6/2013 | Stout |
| RE44,385 | E | 7/2013 | Johnson |
| 8,485,265 | B2 | 7/2013 | Marya et al. |
| 8,486,329 | B2 | 7/2013 | Shikai et al. |
| 8,490,674 | B2 | 7/2013 | Stevens et al. |
| 8,490,689 | B1 | 7/2013 | McClinton et al. |
| 8,506,733 | B2 | 8/2013 | Enami et al. |
| 8,528,633 | B2 | 9/2013 | Agrawal et al. |
| 8,535,604 | B1 | 9/2013 | Baker et al. |
| 8,573,295 | B2 | 11/2013 | Johnson et al. |
| 8,579,023 | B1 | 11/2013 | Nish et al. |
| 8,613,789 | B2 | 12/2013 | Han et al. |
| 8,631,876 | B2 | 1/2014 | Xu et al. |
| 8,663,401 | B2 | 3/2014 | Marya et al. |
| 8,668,762 | B2 | 3/2014 | Kim et al. |
| 8,695,684 | B2 | 4/2014 | Chen et al. |
| 8,695,714 | B2 | 4/2014 | Xu |
| 8,714,268 | B2 | 5/2014 | Agrawal et al. |
| 8,715,339 | B2 | 5/2014 | Atanasoska et al. |
| 8,723,564 | B2 | 5/2014 | Kim et al. |
| 8,734,564 | B2 | 5/2014 | Kim et al. |
| 8,734,602 | B2 | 5/2014 | Li et al. |
| 8,746,342 | B1 | 6/2014 | Nish et al. |
| 8,770,261 | B2 | 7/2014 | Marya |
| 8,776,884 | B2 | 7/2014 | Xu |
| 8,789,610 | B2 | 7/2014 | Oxford |
| 8,808,423 | B2 | 8/2014 | Kim et al. |
| 8,852,363 | B2 | 10/2014 | Numano et al. |
| 8,905,147 | B2 | 12/2014 | Fripp et al. |
| 8,950,504 | B2 | 2/2015 | Xu et al. |
| 8,956,660 | B2 | 2/2015 | Launag et al. |
| 8,967,275 | B2 | 3/2015 | Crews |
| 8,978,734 | B2 | 3/2015 | Stevens |
| 8,991,485 | B2 | 3/2015 | Chenault et al. |
| 8,998,978 | B2 | 4/2015 | Wang |
| 9,010,416 | B2 | 4/2015 | Xu et al. |
| 9,016,363 | B2 | 4/2015 | Xu et al. |
| 9,016,384 | B2 | 4/2015 | Xu |
| 9,022,107 | B2 | 5/2015 | Agrawal et al. |
| 9,027,655 | B2 | 5/2015 | Xu |
| 9,033,041 | B2 | 5/2015 | Baihly et al. |
| 9,033,060 | B2 | 5/2015 | Xu et al. |
| 9,044,397 | B2 | 6/2015 | Choi et al. |
| 9,057,117 | B2 | 6/2015 | Harrison et al. |
| 9,057,242 | B2 | 6/2015 | Mazyar et al. |
| 9,068,428 | B2 | 6/2015 | Mazyar et al. |
| 9,010,424 | B2 | 7/2015 | Xu |
| 9,079,246 | B2 | 7/2015 | Xu et al. |
| 9,080,098 | B2 | 7/2015 | Xu et al. |
| 9,080,403 | B2 | 7/2015 | Xu et al. |
| 9,080,439 | B2 | 7/2015 | O'Malley |
| 9,089,408 | B2 | 7/2015 | Xu |
| 9,090,955 | B2 | 7/2015 | Xu et al. |
| 9,090,956 | B2 | 7/2015 | Xu |
| 9,101,978 | B2 | 8/2015 | Xu |
| 9,109,429 | B2 | 8/2015 | Xu et al. |
| 9,119,906 | B2 | 9/2015 | Tomantschager et al. |
| 9,127,515 | B2 | 9/2015 | Xu et al. |
| 9,163,467 | B2 | 10/2015 | Gaudette et al. |
| 9,181,088 | B2 | 11/2015 | Sibuet et al. |
| 9,187,686 | B2 | 11/2015 | Crews |
| 9,211,586 | B1 | 12/2015 | Avernia et al. |
| 9,217,319 | B2 | 12/2015 | Frazier et al. |
| 9,227,243 | B2 | 1/2016 | Xu et al. |
| 9,243,475 | B2 | 1/2016 | Xu |
| 9,260,935 | B2 | 2/2016 | Murphree et al. |
| 9,284,803 | B2 | 3/2016 | Stone et al. |
| 9,309,733 | B2 | 4/2016 | Xu et al. |
| 9,309,744 | B2 | 4/2016 | Frazier |
| 9,366,106 | B2 | 6/2016 | Xu et al. |
| 9,447,482 | B2 | 9/2016 | Kim et al. |
| 9,458,692 | B2 | 10/2016 | Fripp et al. |
| 9,500,061 | B2 | 11/2016 | Frazier et al. |
| 9,528,343 | B2 | 12/2016 | Jordan et al. |
| 9,587,156 | B2 | 3/2017 | Crews |
| 9,605,508 | B2 | 3/2017 | Xu |
| 9,643,250 | B2 | 5/2017 | Mazyar et al. |
| 9,682,425 | B2 | 6/2017 | Xu et al. |
| 9,689,227 | B2 | 6/2017 | Fripp et al. |
| 9,689,231 | B2 | 6/2017 | Fripp et al. |
| 9,789,663 | B2 | 10/2017 | Zhang et al. |
| 9,790,763 | B2 | 10/2017 | Fripp et al. |
| 9,802,250 | B2 | 10/2017 | Xu |
| 9,803,439 | B2 | 10/2017 | Xu et al. |
| 9,833,838 | B2 | 12/2017 | Mazyar et al. |
| 9,835,016 | B2 | 12/2017 | Zhang et al. |
| 9,863,201 | B2 | 1/2018 | Fripp et al. |
| 9,925,589 | B2 | 3/2018 | Xu |
| 9,926,763 | B2 | 3/2018 | Mazyar et al. |
| 9,938,451 | B2 | 4/2018 | Crews |
| 9,970,249 | B2 | 5/2018 | Zhang et al. |
| 10,016,810 | B2 | 7/2018 | Salinas et al. |
| 10,059,092 | B2 | 8/2018 | Welch et al. |
| 10,059,867 | B2 | 8/2018 | Crews |
| 10,081,853 | B2 | 9/2018 | Wilks et al. |
| 10,082,008 | B2 | 9/2018 | Robey et al. |
| 10,092,953 | B2 | 10/2018 | Mazyar et al. |
| 10,119,358 | B2 | 11/2018 | Walton et al. |
| 10,119,359 | B2 | 11/2018 | Frazier |
| 10,125,565 | B2 | 11/2018 | Fripp et al. |
| 10,167,691 | B2 | 1/2019 | Zhang et al. |
| 10,174,578 | B2 | 1/2019 | Walton et al. |
| 10,202,820 | B2 | 2/2019 | Xu et al. |
| 10,221,637 | B2 | 3/2019 | Xu et al. |
| 10,221,641 | B2 | 3/2019 | Zhang et al. |
| 10,221,642 | B2 | 3/2019 | Zhang et al. |
| 10,221,643 | B2 | 3/2019 | Zhang et al. |
| 10,227,841 | B2 | 3/2019 | Fripp et al. |
| 10,253,590 | B2 | 4/2019 | Xu et al. |
| 10,266,923 | B2 | 4/2019 | Wilks et al. |
| 10,316,601 | B2 | 6/2019 | Walton et al. |
| 10,329,643 | B2 | 6/2019 | Wilks et al. |
| 10,335,855 | B2 | 7/2019 | Welch et al. |
| 10,337,086 | B2 | 7/2019 | Wilks et al. |
| 10,344,568 | B2 | 7/2019 | Murphree et al. |
| 10,364,630 | B2 | 7/2019 | Xu et al. |
| 10,364,631 | B2 | 7/2019 | Xu et al. |
| 10,364,632 | B2 | 7/2019 | Xu et al. |
| 10,450,840 | B2 | 10/2019 | Xu |
| 10,472,909 | B2 | 11/2019 | Xu et al. |
| 10,533,392 | B2 | 1/2020 | Walton et al. |
| 10,544,652 | B2 | 1/2020 | Fripp et al. |
| 10,597,965 | B2 | 3/2020 | Allen |
| 10,612,659 | B2 | 4/2020 | Xu et al. |
| 10,619,438 | B2 | 4/2020 | Fripp et al. |
| 10,619,445 | B2 | 4/2020 | Murphree et al. |
| 10,626,695 | B2 | 4/2020 | Fripp et al. |
| 10,633,947 | B2 | 4/2020 | Fripp et al. |
| 10,655,411 | B2 | 5/2020 | Fripp et al. |
| 10,669,797 | B2 | 6/2020 | Johnson et al. |
| 10,724,321 | B2 | 7/2020 | Leonard et al. |
| 10,737,321 | B2 | 8/2020 | Xu |
| 10,781,658 | B1 | 9/2020 | Kumar et al. |
| 10,807,355 | B2 | 10/2020 | Welch et al. |
| 2002/0020527 | A1 | 2/2002 | Kilaas et al. |
| 2002/0047058 | A1 | 4/2002 | Verhoff et al. |
| 2002/0092654 | A1 | 7/2002 | Coronado et al. |
| 2002/0104616 | A1 | 8/2002 | De et al. |
| 2002/0108756 | A1 | 8/2002 | Harrall et al. |
| 2002/0121081 | A1 | 9/2002 | Cesaroni et al. |
| 2002/0139541 | A1 | 10/2002 | Sheffield et al. |

(56) References Cited

U.S. PATENT DOCUMENTS

2002/0197181 A1 12/2002 Osawa et al.
2003/0019639 A1 1/2003 Mackay
2003/0060374 A1 3/2003 Cooke, Jr.
2003/0104147 A1 6/2003 Bretschneider et al.
2003/0111728 A1 6/2003 Thai et al.
2003/0127013 A1 7/2003 Zavitsanos et al.
2003/0141060 A1 7/2003 Hailey, Jr. et al.
2003/0150614 A1 8/2003 Brown et al.
2003/0155114 A1 8/2003 Pedersen et al.
2003/0173005 A1 9/2003 Higashi
2004/0005483 A1 1/2004 Lin
2004/0055758 A1 3/2004 Brezinski et al.
2004/0069502 A1 4/2004 Luke
2004/0089449 A1 5/2004 Walton et al.
2004/0094297 A1 5/2004 Malone et al.
2004/0154806 A1 8/2004 Bode et al.
2004/0159446 A1 8/2004 Haugen et al.
2004/0216868 A1 11/2004 Owens, Sr.
2004/0231845 A1 11/2004 Cooke, Jr.
2004/0244968 A1 12/2004 Cook et al.
2004/0256109 A1 12/2004 Johnson
2004/0261993 A1 12/2004 Nguyen
2004/0261994 A1 12/2004 Nguyen et al.
2005/0064247 A1 3/2005 Sane et al.
2005/0074612 A1 4/2005 Eklund et al.
2005/0098313 A1 5/2005 Atkins et al.
2005/0102255 A1 5/2005 Bultman
2005/0106316 A1 5/2005 Rigney et al.
2005/0161212 A1 7/2005 Leismer et al.
2005/0165149 A1 7/2005 Chanak et al.
2005/0194141 A1 9/2005 Sinclair et al.
2005/0235757 A1 10/2005 De Jonge et al.
2005/0241824 A1 11/2005 Burris, II et al.
2005/0241825 A1 11/2005 Burris, II et al.
2005/0268746 A1 12/2005 Abkowitz et al.
2005/0269097 A1 12/2005 Towler
2005/0275143 A1 12/2005 Toth
2005/0279427 A1 12/2005 Park et al.
2005/0279501 A1 12/2005 Surjaatmadja et al.
2006/0012087 A1 1/2006 Matsuda et al.
2006/0013350 A1 1/2006 Akers
2006/0057479 A1 3/2006 Niimi et al.
2006/0102871 A1 5/2006 Wang et al.
2006/0108114 A1 5/2006 Johnson
2006/0110615 A1 5/2006 Karim et al.
2006/0113077 A1 6/2006 Willberg et al.
2006/0116696 A1 6/2006 Odermatt et al.
2006/0131031 A1 6/2006 McKeachnie
2006/0131081 A1 6/2006 Mirchandani et al.
2006/0144515 A1 7/2006 Tada et al.
2006/0150770 A1 7/2006 Freim, III et al.
2006/0153728 A1 7/2006 Schoenung et al.
2006/0169453 A1 8/2006 Savery et al.
2006/0175059 A1 8/2006 Sinclair et al.
2006/0186602 A1 8/2006 Martin et al.
2006/0207387 A1 9/2006 Soran et al.
2006/0269437 A1 11/2006 Pandey
2006/0278405 A1 12/2006 Turley
2006/0283592 A1 12/2006 Sierra et al.
2007/0017675 A1 1/2007 Hammami et al.
2007/0134496 A1 1/2007 Katagiri et al.
2007/0039161 A1 2/2007 Garcia
2007/0044958 A1 3/2007 Rytlewski et al.
2007/0044966 A1 3/2007 Davies et al.
2007/0051521 A1 3/2007 Fike et al.
2007/0053785 A1 3/2007 Hetz et al.
2007/0054101 A1 3/2007 Sigalas et al.
2007/0057415 A1 3/2007 Katagiri et al.
2007/0062644 A1 3/2007 Nakamura et al.
2007/0102199 A1 5/2007 Smith et al.
2007/0107899 A1 5/2007 Werner et al.
2007/0108060 A1 5/2007 Park
2007/0131912 A1 6/2007 Simone et al.
2007/0151009 A1 7/2007 Conrad, III et al.
2007/0151769 A1 7/2007 Slutz et al.
2007/0181224 A1 8/2007 Marya et al.
2007/0187095 A1 8/2007 Walker et al.
2007/0207182 A1 9/2007 Weber et al.
2007/0221373 A1 9/2007 Murray
2007/0227745 A1 10/2007 Roberts et al.
2007/0259994 A1 11/2007 Tour et al.
2007/0270942 A1 11/2007 Thomas
2007/0284112 A1 12/2007 Magne et al.
2007/0299510 A1 12/2007 Venkatraman et al.
2008/0011473 A1 1/2008 Wood et al.
2008/0020923 A1 1/2008 Debe et al.
2008/0041500 A1 2/2008 Bronfin
2008/0047707 A1 2/2008 Boney et al.
2008/0060810 A9 3/2008 Nguyen et al.
2008/0081866 A1 4/2008 Gong et al.
2008/0093073 A1 4/2008 Bustos et al.
2008/0121436 A1 5/2008 Slay et al.
2008/0127475 A1 6/2008 Griffo
2008/0149325 A1 6/2008 Crawford
2008/0149345 A1 6/2008 Marya et al.
2008/0149351 A1 6/2008 Marya et al.
2008/0169130 A1 7/2008 Norman et al.
2008/0175744 A1 7/2008 Motegi
2008/0179104 A1 7/2008 Zhang et al.
2008/0196801 A1 8/2008 Zhao et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0220991 A1 9/2008 Slay et al.
2008/0223587 A1 9/2008 Cherewyk
2008/0236829 A1 10/2008 Lynde
2008/0236842 A1 10/2008 Bhavsar et al.
2008/0248205 A1 10/2008 Blanchet et al.
2008/0248413 A1 10/2008 Ishii et al.
2008/0264205 A1 10/2008 Zeng et al.
2008/0264594 A1 10/2008 Lohmueller et al.
2008/0277980 A1 11/2008 Koda et al.
2008/0282924 A1 11/2008 Saenger et al.
2008/0296024 A1 12/2008 Huang et al.
2008/0302538 A1 12/2008 Hofman
2008/0314581 A1 12/2008 Brown
2008/0314588 A1 12/2008 Langlais et al.
2009/0038858 A1 2/2009 Griffo et al.
2009/0044946 A1 2/2009 Shasteen et al.
2009/0044955 A1 2/2009 King et al.
2009/0050334 A1 2/2009 Marya et al.
2009/0056934 A1 3/2009 Xu
2009/0065216 A1 3/2009 Frazier
2009/0068051 A1 3/2009 Gross
2009/0074603 A1 3/2009 Chan et al.
2009/0084600 A1 4/2009 Severance
2009/0090440 A1 4/2009 Kellett
2009/0107684 A1 4/2009 Cooke, Jr.
2009/0114381 A1 5/2009 Stroobants
2009/0116992 A1 5/2009 Lee
2009/0126436 A1 5/2009 Fly et al.
2009/0151949 A1 6/2009 Marya et al.
2009/0152009 A1 6/2009 Slay et al.
2009/0155616 A1 6/2009 Thamida
2009/0159289 A1 6/2009 Avant et al.
2009/0194745 A1 8/2009 Tanaka
2009/0205841 A1 8/2009 Kluge et al.
2009/0211770 A1 8/2009 Nutley et al.
2009/0226340 A1 9/2009 Marya
2009/0226704 A1 9/2009 Kauppinen et al.
2009/0242202 A1 10/2009 Rispler et al.
2009/0242208 A1 10/2009 Bolding
2009/0255667 A1 10/2009 Clem et al.
2009/0255684 A1 10/2009 Bolding
2009/0255686 A1 10/2009 Richard et al.
2009/0260817 A1 10/2009 Gambier et al.
2009/0266548 A1 10/2009 Olsen et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0308588 A1 12/2009 Howell et al.
2009/0317556 A1 12/2009 Macary

(56) References Cited

U.S. PATENT DOCUMENTS

| | | | |
|---|---|---|---|
| 2009/0317622 | A1 | 12/2009 | Huang et al. |
| 2010/0003536 | A1 | 1/2010 | Smith et al. |
| 2010/0012385 | A1 | 1/2010 | Drivdahl et al. |
| 2010/0015002 | A1 | 1/2010 | Barrera et al. |
| 2010/0015469 | A1 | 1/2010 | Romanowski |
| 2010/0025255 | A1 | 2/2010 | Su et al. |
| 2010/0038076 | A1 | 2/2010 | Spray et al. |
| 2010/0038595 | A1 | 2/2010 | Imholt et al. |
| 2010/0040180 | A1 | 2/2010 | Kim et al. |
| 2010/0044041 | A1 | 2/2010 | Smith et al. |
| 2010/0051278 | A1 | 3/2010 | Mytopher et al. |
| 2010/0055492 | A1 | 3/2010 | Baroum et al. |
| 2010/0089583 | A1 | 4/2010 | Xu et al. |
| 2010/0116495 | A1 | 5/2010 | Spray |
| 2010/0119405 | A1 | 5/2010 | Okamoto et al. |
| 2010/0139930 | A1 | 6/2010 | Patel et al. |
| 2010/0161031 | A1 | 6/2010 | Papirov et al. |
| 2010/0200230 | A1 | 8/2010 | East, Jr. et al. |
| 2010/0236793 | A1 | 9/2010 | Bjorgum |
| 2010/0236794 | A1 | 9/2010 | Duan et al. |
| 2010/0243254 | A1 | 9/2010 | Murphy et al. |
| 2010/0252273 | A1 | 10/2010 | Duphorne |
| 2010/0252280 | A1 | 10/2010 | Swor et al. |
| 2010/0270031 | A1 | 10/2010 | Patel |
| 2010/0276136 | A1 | 11/2010 | Evans et al. |
| 2010/0276159 | A1 | 11/2010 | Mailand et al. |
| 2010/0282338 | A1 | 11/2010 | Gerrard et al. |
| 2010/0282469 | A1 | 11/2010 | Richard et al. |
| 2010/0297432 | A1 | 11/2010 | Sherman et al. |
| 2010/0304178 | A1 | 12/2010 | Dirscherl |
| 2010/0304182 | A1 | 12/2010 | Facchini et al. |
| 2010/0314105 | A1 | 12/2010 | Rose |
| 2010/0314127 | A1 | 12/2010 | Swor et al. |
| 2010/0319427 | A1 | 12/2010 | Lohbeck et al. |
| 2010/0326650 | A1 | 12/2010 | Tran et al. |
| 2011/0005773 | A1 | 1/2011 | Dusterhoft et al. |
| 2011/0036592 | A1 | 2/2011 | Fay |
| 2011/0048743 | A1 | 3/2011 | Stafford et al. |
| 2011/0052805 | A1 | 3/2011 | Bordere et al. |
| 2011/0067872 | A1 | 3/2011 | Agrawal |
| 2011/0067889 | A1 | 3/2011 | Marya et al. |
| 2011/0091660 | A1 | 4/2011 | Dirscherl |
| 2011/0094406 | A1 | 4/2011 | Marya et al. |
| 2011/0135530 | A1 | 6/2011 | Xu et al. |
| 2011/0135805 | A1 | 6/2011 | Doucet et al. |
| 2011/0139465 | A1 | 6/2011 | Tibbles et al. |
| 2011/0147014 | A1 | 6/2011 | Chen et al. |
| 2011/0186306 | A1 | 8/2011 | Marya et al. |
| 2011/0192613 | A1 | 8/2011 | Garcia et al. |
| 2011/0214881 | A1 | 9/2011 | Newton et al. |
| 2011/0221137 | A1 | 9/2011 | Obi et al. |
| 2011/0236249 | A1 | 9/2011 | Kim et al. |
| 2011/0247833 | A1 | 10/2011 | Todd et al. |
| 2011/0253387 | A1 | 10/2011 | Ervin |
| 2011/0259610 | A1 | 10/2011 | Shkurti et al. |
| 2011/0277987 | A1 | 11/2011 | Frazier |
| 2011/0277989 | A1 | 11/2011 | Frazier |
| 2011/0277996 | A1 | 11/2011 | Cullick et al. |
| 2011/0284232 | A1 | 11/2011 | Huang |
| 2011/0284240 | A1 | 11/2011 | Chen et al. |
| 2011/0284243 | A1 | 11/2011 | Frazier |
| 2011/0300403 | A1 | 12/2011 | Vecchio et al. |
| 2011/0314881 | A1 | 12/2011 | Hatcher et al. |
| 2012/0046732 | A1 | 2/2012 | Sillekens et al. |
| 2012/0067426 | A1 | 3/2012 | Soni et al. |
| 2012/0080189 | A1 | 4/2012 | Marya et al. |
| 2012/0090839 | A1 | 4/2012 | Rudic |
| 2012/0097384 | A1 | 4/2012 | Valencia et al. |
| 2012/0103135 | A1 | 5/2012 | Xu et al. |
| 2012/0125642 | A1 | 5/2012 | Chenault |
| 2012/0130470 | A1 | 5/2012 | Agnew et al. |
| 2012/0145378 | A1 | 6/2012 | Frazier |
| 2012/0145389 | A1 | 6/2012 | Fitzpatrick, Jr. |
| 2012/0156087 | A1 | 6/2012 | Kawabata |
| 2012/0168152 | A1 | 7/2012 | Casciaro |
| 2012/0177905 | A1 | 7/2012 | Seals et al. |
| 2012/0190593 | A1 | 7/2012 | Soane et al. |
| 2012/0205120 | A1 | 8/2012 | Howell |
| 2012/0205872 | A1 | 8/2012 | Reinhardt et al. |
| 2012/0211239 | A1 | 8/2012 | Kritzler et al. |
| 2012/0234546 | A1 | 9/2012 | Xu |
| 2012/0234547 | A1 | 9/2012 | O'Malley et al. |
| 2012/0247765 | A1 | 10/2012 | Agrawal et al. |
| 2012/0267101 | A1 | 10/2012 | Cooke, Jr. |
| 2012/0269673 | A1 | 10/2012 | Koo et al. |
| 2012/0273229 | A1 | 11/2012 | Xu et al. |
| 2012/0318513 | A1 | 12/2012 | Mazyar et al. |
| 2013/0000985 | A1 | 1/2013 | Agrawal et al. |
| 2013/0008671 | A1 | 1/2013 | Booth |
| 2013/0017610 | A1 | 1/2013 | Roberts et al. |
| 2013/0022816 | A1 | 1/2013 | Smith et al. |
| 2013/0029886 | A1 | 1/2013 | Mazyar et al. |
| 2013/0032357 | A1 | 2/2013 | Mazyar et al. |
| 2013/0043041 | A1 | 2/2013 | McCoy et al. |
| 2013/0047785 | A1 | 2/2013 | Xu |
| 2013/0052472 | A1 | 2/2013 | Xu |
| 2013/0056215 | A1 | 3/2013 | Crews |
| 2013/0068411 | A1 | 3/2013 | Forde et al. |
| 2013/0068461 | A1 | 3/2013 | Maerz et al. |
| 2013/0084643 | A1 | 4/2013 | Commarieu et al. |
| 2013/0105159 | A1 | 5/2013 | Alvarez et al. |
| 2013/0112429 | A1 | 5/2013 | Crews |
| 2013/0126190 | A1 | 5/2013 | Mazyar et al. |
| 2013/0133897 | A1 | 5/2013 | Bailhly et al. |
| 2013/0144290 | A1 | 6/2013 | Schiffl et al. |
| 2013/0146144 | A1 | 6/2013 | Joseph et al. |
| 2013/0160992 | A1 | 6/2013 | Agrawal et al. |
| 2013/0167502 | A1 | 7/2013 | Wilson et al. |
| 2013/0168257 | A1 | 7/2013 | Mazyar et al. |
| 2013/0186626 | A1 | 7/2013 | Aitken et al. |
| 2013/0199800 | A1 | 8/2013 | Kellner et al. |
| 2013/0209308 | A1 | 8/2013 | Mazyar et al. |
| 2013/0220496 | A1 | 8/2013 | Noue et al. |
| 2013/0240200 | A1 | 9/2013 | Frazier |
| 2013/0240203 | A1 | 9/2013 | Frazier |
| 2013/0261735 | A1 | 10/2013 | Pacetti et al. |
| 2013/0277044 | A1 | 10/2013 | King et al. |
| 2013/0310961 | A1 | 11/2013 | Velez |
| 2013/0048289 | A1 | 12/2013 | Mazyar |
| 2013/0319668 | A1 | 12/2013 | Tschetter et al. |
| 2013/0327540 | A1 | 12/2013 | Hamid et al. |
| 2014/0018489 | A1 | 1/2014 | Johnson |
| 2014/0020712 | A1 | 1/2014 | Benson |
| 2014/0027128 | A1 | 1/2014 | Johnson |
| 2014/0060834 | A1 | 3/2014 | Quintero |
| 2014/0093417 | A1 | 4/2014 | Liu |
| 2014/0110112 | A1 | 4/2014 | Jordan, Jr. |
| 2014/0116711 | A1 | 5/2014 | Tang |
| 2014/0124216 | A1 | 5/2014 | Fripp et al. |
| 2014/0154341 | A1 | 6/2014 | Manuel et al. |
| 2014/0186207 | A1 | 7/2014 | Bae et al. |
| 2014/0190705 | A1 | 7/2014 | Fripp |
| 2014/0196889 | A1 | 7/2014 | Jordan et al. |
| 2014/0202284 | A1 | 7/2014 | Kim |
| 2014/0202708 | A1 | 7/2014 | Jacob et al. |
| 2014/0219861 | A1 | 8/2014 | Han |
| 2014/0224477 | A1 | 8/2014 | Wiese et al. |
| 2014/0236284 | A1 | 8/2014 | Stinson |
| 2014/0271333 | A1 | 9/2014 | Kim et al. |
| 2014/0286810 | A1 | 9/2014 | Marya |
| 2014/0305627 | A1 | 10/2014 | Manke |
| 2014/0311731 | A1 | 10/2014 | Smith |
| 2014/0311752 | A1 | 10/2014 | Streich et al. |
| 2014/0360728 | A1 | 12/2014 | Tashiro et al. |
| 2014/0374086 | A1 | 12/2014 | Agrawal et al. |
| 2015/0060085 | A1 | 3/2015 | Xu |
| 2015/0065401 | A1 | 3/2015 | Xu et al. |
| 2015/0102179 | A1 | 4/2015 | McHenry et al. |
| 2015/0184485 | A1 | 7/2015 | Xu et al. |
| 2015/0240337 | A1 | 8/2015 | Sherman et al. |
| 2015/0247376 | A1 | 9/2015 | Tolman et al. |
| 2015/0299838 | A1 | 10/2015 | Doud |
| 2015/0354311 | A1 | 12/2015 | Okura et al. |
| 2016/0024619 | A1 | 1/2016 | Wilks |

(56) References Cited

U.S. PATENT DOCUMENTS

| | | | |
|---|---|---|---|
| 2016/0128849 | A1 | 5/2016 | Yan et al. |
| 2016/0201425 | A1 | 7/2016 | Walton |
| 2016/0201427 | A1 | 7/2016 | Fripp |
| 2016/0201435 | A1 | 7/2016 | Fripp et al. |
| 2016/0209391 | A1 | 7/2016 | Zhang et al. |
| 2016/0230494 | A1 | 8/2016 | Fripp et al. |
| 2016/0251934 | A1 | 9/2016 | Walton |
| 2016/0258242 | A1 | 9/2016 | Hayter et al. |
| 2016/0265091 | A1 | 9/2016 | Walton et al. |
| 2016/0272882 | A1 | 9/2016 | Stray et al. |
| 2016/0279709 | A1 | 9/2016 | Xu et al. |
| 2017/0050159 | A1 | 2/2017 | Xu et al. |
| 2017/0266923 | A1 | 9/2017 | Guest et al. |
| 2017/0356266 | A1 | 12/2017 | Arackakudiyil et al. |
| 2018/0010217 | A1 | 1/2018 | Wilks et al. |
| 2018/0023359 | A1 | 1/2018 | Xu |
| 2018/0178289 | A1 | 6/2018 | Xu et al. |
| 2018/0187510 | A1 | 7/2018 | Xu et al. |
| 2018/0216431 | A1 | 8/2018 | Walton et al. |
| 2018/0274317 | A1 | 9/2018 | Hall |
| 2019/0054523 | A1 | 2/2019 | Wolf et al. |
| 2019/0093450 | A1 | 3/2019 | Walton et al. |
| 2019/0203563 | A1 | 7/2019 | Gano et al. |
| 2019/0249510 | A1 | 8/2019 | Deng et al. |

FOREIGN PATENT DOCUMENTS

| | | |
|---|---|---|
| CA | 2886988 | 10/2015 |
| CN | 1076968 | 10/1993 |
| CN | 1079234 | 12/1993 |
| CN | 1255879 | 6/2000 |
| CN | 1668545 | 9/2005 |
| CN | 1882759 | 12/2006 |
| CN | 101050417 | 10/2007 |
| CN | 101351523 | 1/2009 |
| CN | 101381829 | 3/2009 |
| CN | 101392345 | 3/2009 |
| CN | 101454074 | 6/2009 |
| CN | 101457321 | 6/2009 |
| CN | 101605963 | 12/2009 |
| CN | 101720378 | 6/2010 |
| CN | 102517489 | 6/2012 |
| CN | 102796928 | 11/2012 |
| CN | 103343271 | 10/2013 |
| CN | 103602865 | 2/2014 |
| CN | 103898384 | 7/2014 |
| CN | 104004950 | 8/2014 |
| CN | 104152775 | 11/2014 |
| CN | 104480354 | 4/2015 |
| CN | 201532089 | 4/2015 |
| CN | 104651692 | 5/2015 |
| CN | 10577976 | 7/2016 |
| CN | 106086559 | 11/2016 |
| EA | 200600343 | 6/2006 |
| EA | 200870227 | 2/2009 |
| EP | 0033625 | 8/1981 |
| EP | 0400574 | 5/1990 |
| EP | 0470599 | 2/1998 |
| EP | 1006258 | 1/2000 |
| EP | 1174385 | 1/2002 |
| EP | 1412175 | 4/2004 |
| EP | 1493517 | 1/2005 |
| EP | 1798301 | 6/2007 |
| EP | 1857570 | 11/2007 |
| EP | 2088217 | 8/2009 |
| GB | 912956 | 12/1962 |
| GB | 1046330 | 10/1966 |
| GB | 1280833 | 7/1972 |
| GB | 1357065 | 6/1974 |
| GB | 2095288 | 9/1982 |
| GB | 2529062 | 2/2016 |
| JP | H10147830 | 6/1998 |
| JP | 2000073152 | 3/2000 |
| JP | 2000185725 | 7/2000 |
| JP | 2002053902 | 2/2002 |
| JP | 2004154837 | 6/2004 |
| JP | 2004225084 | 8/2004 |
| JP | 2004225765 | 8/2004 |
| JP | 2005076052 | 3/2005 |
| JP | 2008266734 | 11/2008 |
| JP | 2008280565 | 11/2008 |
| JP | 2009144207 | 7/2009 |
| JP | 2010502840 | 1/2010 |
| JP | 2012197491 | 10/2012 |
| JP | 2013019030 | 1/2013 |
| JP | 2014043601 | 3/2014 |
| KR | 20130023707 | 3/2013 |
| NO | 2013109287 | 7/2013 |
| RU | 2373375 | 7/2006 |
| WO | 9111587 | 8/1881 |
| WO | 1990002655 | 3/1990 |
| WO | 9200961 | 1/1992 |
| WO | 1992013978 | 8/1992 |
| WO | 9857347 | 12/1998 |
| WO | 9909227 | 2/1999 |
| WO | 1999027146 | 6/1999 |
| WO | 9947726 | 9/1999 |
| WO | 2001001087 | 1/2001 |
| WO | 2004001087 | 12/2003 |
| WO | 2004073889 | 9/2004 |
| WO | 2005065281 | 7/2005 |
| WO | 2007044635 | 4/2007 |
| WO | 2007095376 | 8/2007 |
| WO | 2008017156 | 2/2008 |
| WO | 2008034042 | 3/2008 |
| WO | 2008057045 | 5/2008 |
| WO | 2008079485 | 7/2008 |
| WO | 2008079777 | 7/2008 |
| WO | 2008142129 | 11/2008 |
| WO | 2009055354 | 4/2009 |
| WO | 2009079745 | 7/2009 |
| WO | 2009093420 | 7/2009 |
| WO | 2010012184 | 2/2010 |
| WO | 2010038016 | 4/2010 |
| WO | 2010083826 | 7/2010 |
| WO | 2010110505 | 9/2010 |
| WO | 2011071902 | 6/2011 |
| WO | 2011071907 | 6/2011 |
| WO | 2011071910 | 6/2011 |
| WO | 2011130063 | 10/2011 |
| WO | 2012015567 | 2/2012 |
| WO | 2012071449 | 5/2012 |
| WO | 2012091984 | 7/2012 |
| WO | 2012149007 | 11/2012 |
| WO | 2012164236 | 12/2012 |
| WO | 2012174101 | 12/2012 |
| WO | 2012175665 | 12/2012 |
| WO | 2013019410 | 2/2013 |
| WO | 2013019421 | 2/2013 |
| WO | 2013053057 | 4/2013 |
| WO | 2013078031 | 5/2013 |
| WO | 2013122712 | 8/2013 |
| WO | 2013154634 | 10/2013 |
| WO | 2014100141 | 6/2014 |
| WO | 2014113058 | 7/2014 |
| WO | 2014121384 | 8/2014 |
| WO | 2014210283 | 12/2014 |
| WO | 2015127177 | 8/2015 |
| WO | 2015142862 | 9/2015 |
| WO | 2015161171 | 10/2015 |
| WO | 2015171126 | 11/2015 |
| WO | 2015171585 | 11/2015 |
| WO | 2016024974 | 2/2016 |
| WO | 2016032490 | 3/2016 |
| WO | 2016032493 | 3/2016 |
| WO | 2016032619 | 3/2016 |
| WO | 2016032620 | 3/2016 |
| WO | 2016032621 | 3/2016 |
| WO | 2016032758 | 3/2016 |
| WO | 2016032761 | 3/2016 |
| WO | 2016036371 | 3/2016 |
| WO | 2016085798 | 6/2016 |

(56) References Cited

FOREIGN PATENT DOCUMENTS

| | | |
|---|---|---|
| WO | 2016165041 | 10/2016 |
| WO | 2020018110 | 1/2020 |
| WO | 2020109770 | 6/2020 |

OTHER PUBLICATIONS

Hillis et al., "High Purity Magnesium AM60 Alloy: The Critical Contaminant Limits and the Salt Water Corrosion Performance", SAE Technical Paper Series (1986).
Pawar, S.G., "Influence of Microstructure on the Corrosion Behaviour of Magnesium Alloys", PhD Dissertation, University of Manchester (2011).
Czerwinski, "Magnesium Injection Molding"; Technology & Engineering; Springer Science + Media, LLC, pp. 107-108, (Dec. 2007).
Metals Handbook, Desk Edition, edited by J.R. David, published by ASM International, pp. 559-574 (1998).
Hassan et al., "Development of high strength magnesium based composites using elemental nickel particulates as reinforcement", Journal of Materials Science, vol. 37, pp. 2467-2474 (2002).
Machine Translation of CN103898384 (originally submitted in Information Disclosure Statement filed Sep. 24, 2020).
Machine Translation of KR 20130023707 (originally cited in Information Disclosure Statement filed Sep. 24, 2020).
Machine Translation of CN103602865 (originally cited in Information Disclosure Statement filed Sep. 24, 2020).
Machine Translation of CN101381829 (originally cited in Information Disclosure Statement filed Sep. 11, 2020).
Machine Translation of CN102518489 (originally cited in Information Disclosure Statement filed Sep. 11, 2020).
Machine Translation of CN 103343271 (originally cited in Information Disclosure Statement filed Sep. 11, 2020).
Machine Translation of CN102796928 (originally cited in Information Disclosure Statement filed Sep. 11, 2020).
Machine Translation of JP2008266734 (originally cited in Information Disclosure Statement filed Sep. 11, 2020).
Machine Translation of JP2012197491 (originally cited in Information Disclosure Statement filed Sep. 11, 2020).
Machine Translation of JP2013019030 (originally cited in Information Disclosure Statement filed Sep. 11, 2020).
Machine Translation of JP2014043601 (originally cited in Information Disclosure Statement filed Sep. 11, 2020).
Machine Translation of CN104004950 (See Foreign Patent Document # 2).
Machine Translation of CN104651691 (See Foreign Patent Document # 3).
United States District Court / Western District of Oklahoma, Case No. 5:21-cv-1115, *Magnesium Machine LLC* v. *Terves LLC*, Docket Report (Jan. 24, 2023).
United States District Court/ Northern District of Ohio, Case No. 1:19-cv-1611, *Terves LLC* v. *Yueyang Aerospace New Materials Co. Ltd.*, Partial Docket Report (Jan. 24, 2023).
U.S. Court of Appeals / Federal District, *Terves LLC* v. *Yueyang Aerospace New Materials Co. Ltd.*, Docket Report (Jan. 24, 2023).
United States District Court / West District of Oklahoma, Case No. 5:21-cv-1115, *Magnesium Machine, LLC* v. *Terves LLC*, "Complaint for Declaration Judgment of Non-Infringment, Invalidity, and Unenforceability of Patents, Tortious Interference Contract and Prospective Economic Advantage and Unfair Competition" (Nov. 23, 2021).
United States District Court / Northern District of Ohio, Eastern Division, Case No. 1:19-cv-1611, *Terves LLC* v. *Yueyang Aerospace New Materials Co. Ltd.*, "Memorandum in Support of Defendants' Motion for Summary Judgment" (Nov. 18, 2021).
Patent Trial and Appeal Board / Federal District, *Chongqing Yanmei Technology Co., LTD* v. *Terves LLC*; Declaration Under 37 CFR 1.68 of Dr. Juan C. Nava, Ph.D. (filed Jan. 24, 2023).
Curriculum Vitae of Dr. Juan C. Nava, Ph.D.
Patent Trial and Appeal Board / Federal District, *Chongqing Yanmei Technology Co., LTD* v. *Terves LLC*; "Petition for Inter Partes Review of U.S. Pat. No. 10,689,740" (filed Jan. 24, 2023).
Sigworth et al. "Grain Refinement of Aluminum Castings Alloys" American Foundry Society; Paper 07-67; pp. 5-7 (2007).
Momentive, "Titanium Diborid Powder" condensed product brochure; retrieved from https:/www.momentive.com/WorkArea/DownloadAsset.aspx?id+27489.; p. 1 (2012).
Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf> (2005).
Pegeut et al.., "Influence of cold working on the pitting corrosion resistance of stainless steel" Corrosion Science, vol. 49, pp. 1933-1948 (2007).
Elemental Charts from chemicalelements.com; retrieved Jul. 27, 2017.
Song et al., "Corrosion Mechanisms of Magnesium Alloys" Advanced Engg Materials, vol. 1, No. 1 (1999).
Zhou et al., "Tensile Mechanical Properties and Strengthening Mechanism of Hybrid Carbon Nanotubes . . . " Journal of Nanomaterials, 2012; 2012:851862 (doi: 10.1155/2012/851862) Figs. 6 and 7.
Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].
AZoNano "Silicon Carbide Nanoparticles-Properties, Applications" http://www.amazon.com/articles.aspx?ArticleD=3396) p. 2, Physical Properties, Thermal Properties (May 9, 2013).
AZoM "Magnesium AZ91D-F Alloy" http://www.amazon.com/articles.aspx?ArticleD=8670) p. 1, Chemical Composition; p. 2 Physical Properties (Jul. 31, 2013.
Elasser et al., "Silicon Carbide Benefits and Advantages . . . " Proceedings of the IEEE, 2002; 906(6):969-986 (doi: 10.1109/JPROC.2002.1021562) p. 970, Table 1.
Lan et al., "Microstructure and Microhardness of SiC Nanoparticles . . . " Materials Science and Engineering A; 386:284-290 (2004).
Casati et al., "Metal Matrix Composites Reinforced by Nanoparticles", vol. 4:65-83 (2014).
Hemanth, "Fracture Behavior of Cryogenically solidifed aluminum-alloy reinforced with Nano-ZrO2 Metal Matrix Composites (CNMMCs)", Journal of Chemical Engineering and Materials Science, vol. 2(8), pp. 110-121 (Aug. 2011).
United States District Court/Northern District of Ohio/Eastern Division, Supplemental Declaration of Dana J. Medlin, Ph.D. in Support of Opposition to Terves LLC'S Motion for Preliminary Injunction in related Case 1:19-CV-1611 (filed Oct. 15, 2020).
United States District Court/Northern District of Ohio/Eastern Division, Declaration of Andrew Sherman in Support of Terves' Preliminary Injunction Motion in related Case 1:19-CV-1611 (filed May 1, 2020).
Shimizu et al., "Multi-walled carbon nanotube-reinforced magnesium alloy composites", Scripta Materialia, vol. 58, pp. 267-270 (2008).
Zhan et al., "Single-wall carbon nanotubes as attractive toughening agents in alumina-based nanocomposites", Nature Materials, vol. 2, pp. 38-42 (Jan. 2003).
Curtin et al., "CNT-reinforced ceramics and metals", Materials Today, vol. 7, pp. 44-49 (2004).
Pardo et al., "Corrosion behavior of magnesium/aluminum alloys in 3.5 wt.% NaCl", Corrosion Science, vol. 50, pp. 823-834 (2008).
Song et L., "Influence of microstructure on the corrosion of diecast AZ91D", Corrosion Science, vol. 41, pp. 249-273 (1999).
Watarai, "Trend of Research and Development for Magnesium Alloys—Reducing the Weight of Structural Materials in Motor Vehicles", Science & Technology Trends, Quarterly Review, No. 18, pp. 84-97 (Jan. 2006).
Saravanan et al., "Mechanically Alloyed Carbon Nanotubes (CNT) Reinforced Nanocrystalline AA 4032: Synthesis and Characterization", Journal of Minerals & Materials Characterization & Engineering, vol. 9, No. 11, pp. 1027-1035 (2010).

(56) References Cited

OTHER PUBLICATIONS

Tsipas et al., "Effect of high energy ball milling on titanium-hydroxyapatite powders", Powder Metallurgy, vol. 46, No. 1 pp. 73-77 (2003).
Xie et al., "TEM Observation of Interfaces between Particles in Al—Mg Powder Compacts Prepared by Pulse Electric Current Sintering", Materials Transactions, vol. 43, No. 9, pp. 2177-2180 (2002).
Elsayed et al., "Effect of Consolidation and Extrusion Temperatures on Tensile Properties of Hot Extruded ZK61 Magnesium Alloy Gas Atomized Powders via Spark Plasma Sintering", Tranasctions of JWRI, vol. 38, No. 2, p. 31.
Shigematsu et al., "Surface treatment of AZ91D magnesium alloy by aluminum diffusion coating", Journal of Materials Science Letters, vol. 19, pp. 473-475 (2000).
Spencer et al., "Fluidized Bed Polymer Particle ALD Process for Producing HDPE/Alumina Nanocomposites", 12th International Conference on Fluidization, vol. RP4 (2007).
Maisano, "Cryomilling of Aluminum-Based and Magnesium-Based Metal Powders", Thesis, Virginia Tech (Jan. 2006).
Walters et al., "A Study of Jets from Unsintered-Powder Metal Lined Nonprecision Small-Caliber Shaped Charges", Army Research Laboratory, Aberdeen Proving Group, MC 21005-5066 (Feb. 2001).
National Physical Laboratory, "Bimetallic Corrosion" Crown (C) p. 1-14 (2000).
Ye et al., "Review of recent studies in magnesium matrix composites", Journal of Material Science, vol. 39, pp. 6153-6171 (2004).
Hassan et al., "Development of a novel magnesium-copper based composite with improved mechanical properties", Materials Research Bulletin, vol. 37, pp. 377-389 (2002).
Ye et al., "Microstructure and tensile properties of Ti6A14V/AM60B magnesium matrix composite", Journal of Alloys and Composites, vol. 402, pp. 162-169 (2005).
Kumar et al., "Mechanical and Tribological Behavior of Particulate Reinforced Aluminum metal Matrix Composite", Journal of Minerals & Materials Characterization and Engineering, vol. 10, pp. 59-91 (2011).
Majumdar, "Micromechanics of Discontinuously Reinforced MMCs", Engineering Mechanics and Analysis of Metal-Matrix Composites, vol. 21, pp. 395-406.
United States District Court/Northern District of Ohio/Eastern Division, Memorandum Opinion and Order in related Case 1:19-CV-1611 (issued Mar. 29, 2021).
United States District Court/Northern District of Ohio/Eastern Division, Second Rebuttal Rule 26 Report of Lee A. Swanger, Ph.D., P.E. in related Case 1:19-CV-1611 (filed Nov. 24, 2020).
U.S. Patent and Trademark Office, Declaration of Dana J. Medlin in Support of Request for Ex Parte Reexamination of U.S. Pat. No. 10,329,653 (filed Jul. 6, 2021).
Ashby, "Teach Yourself Phase Diagrams and Phase Transformations", Cambridge, 5th Edition, pp. unknown (March 2009).
Callister, Materials Science and Engineering an Introduction:, 6th Edition, New York, pp. unknown (2003).
Hanson et al. Constitution of Binary Alloys:, McGraw-Hill Book Co. Inc., pp. unknown (1958).
MSE 2090: Introduction to Materials Science, Chapter 9, pp. unknown (date unknown).
Metals Handbook, "Metallography, Structures and Phase Diagrams", Aluminum-Magnesium, American Society For Metals, 8th Edition, vol. 8, pp. unknown (1973).
Metals Handbook, "Metallography, Structures and Phase Diagrams", Magnesium-Nickel, American Society for Metals, 8th Edition, vol. 8, pp. unknown (1973).
Principles and Prevention of Corrosion, "Volts versus saturated calomel reference electrobe", D.A. Jones, p. 170 (1996).
Medlin, "Mass Balance", handwritten notes (Nov. 2020).
Metals Handbook, "Metallography, Structures and Phase Diagrams", Aluminum-Iron, American Society for Metals, 8th Edition, vol. 8, p. 260 (1973).
Metals Handbook, "Metallography, Structures and Phase Diagrams", Aluminum-Nickel, American Society for Metals, 8th Edition, vol. 8, p. 261 (1973).
Metals Handbook, "Metallography, Structures and Phase Diagrams", Aluminum-Copper, American Society for Metals, 8th Edition, vol. 8, p. 259 (1973).
Metals Handbook, "Metallography, Structures and Phase Diagrams", Silver-Aluminum, American Society for Metals, 8th Edition, vol. 8, p. 252 (1973).
Medlin, Declaration of Dona J. Medlin Ph.D., P.E., FASM Under 37 CFR Section 1.68 in Support of Petition For Inter Partes Review of U.S. Pat. No. 9,903,010 (Sep. 2020).
Li, Qiang, "Translation Declaration and Translation of China Patent Publication No. 103343271" (Jun. 2020).
Ho et al., The mechanical behavior of magnesium alloy AZ91 reinforced with fine copper particulates:, Materials Science and Engineering A369, pp. 302-308 (2004).
Trojanova et al., "Mechanical and fracture properties of an AZ91 Magnesium alloy reinforced by Si and SiC particles", Composites Science and Technology, vol. 69, pp. 2256-2264 (2009).
Lin et al., "Formation of Magnesium Metal Matrix Composites Al2O3p/AZ91D and Their Mechanical Properties After Heat Treatment" Acta Metallurgica Slovaca, vol. 16, pp. 237-245 (2010).
Saravanan et al., "Fabrication and characterization of pure magnesium-30 vol. SiCP particle composite", Material Science and Eng., vol. 276, pp. 108-116 (2000).
Song et al., "Texture evolution and mechanical properties of AZ31B magnesium alloy sheets processed by repeated unidirectional bending", Journal of Alloys and Compounds, vol. 489, pp. 475-481 (2010).
Blawert et al., "Magnesium secondary alloys: Alloy design for magnesium alloys with improved tolerance limits against impurities", Corrosion Science, vol. 52, No. 7, pp. 2452-2468 (Jul. 1, 2010).
Wang et al., "Effect of Ni on microstructures and mechanical properties of AZ1 02 magnesium alloys" Zhuzao Foundry, Shenyang Zhuzao Yanjiusuo, vol. 62, No. 1, pp. 315-318 (Jan. 1, 2013).
Kim et al., "Effect of aluminum on the corrosions characteristics of Mg—4Ni—xAl alloys", Corrosion, vol. 59, No. 3, pp. 228-237 (Jan. 1, 2003).
Unsworth et al., "A new magnesium alloy system", Light Metal Age, vol. 37, No. 7-8., pp. 29-32 (Jan. 1, 1979).
Geng et al., "Enhanced age-hardening response of Mg—Zn alloys via Co additions", Scripta Materialia, vol. 64, No. 6, pp. 506-509 (Mar. 1, 2011).
Zhu et al., "Microstructure and mechanical properties of Mg6ZnCuO.6Zr (wt.%) alloys", Journal of Alloys and Compounds, vol. 509, No. 8, pp. 3526-3531 (Dec. 22, 2010).
International Search Authority, International Search Report and Written Opinion for PCT/GB2015/052169 (dated Feb. 17, 2016).
Search and Examination Report for GB 1413327.6 (dated Jan. 21, 2015).
Magnesium Elektron Test Report (Mar. 8, 2005).
New England Fishery Management Counsel, "Fishery Management Plan for American Lobster Amendment 3" (Jul. 1989).
Emly, E.F., "Principles of Magnesium Technology" Pergamon Press, Oxford (1966).
Shaw, "Corrosion Resistance of Magnesium Alloys", ASM Handbook, vol. 13A, pp. 692-696 (2003).
Hanawalt et al., "Corrosion studies of magnesium and its alloys", Metals Technology, Technical Paper 1353 (1941).
The American Foundry Society, Magnesium alloys, casting source directory 8208, available at www.afsinc.org/files/magnes.pdf.
Rokhlin, "Magnesium alloys containing rare earth metals structure and properties", Advances in Metallic Alloys, vol. 3, Taylor & Francis (2003).
Ghali, "Corrosion Resistance of Aluminum and Magnesium Alloys" pp. 382-389, Wiley Publishing (2010).
Kim et al., "High Mechanical Strengths of Mg—Ni—Y and MG—Cu Amorphous Alloys with Significant Supercooled Liquid Region", Materials Transactions, vol. 31, No. 11, pp. 929-934 (1990).
Tekumalla et al., "Mehcanical Properties of Magnesium-Rare Earth Alloy Systems", Metals, vol. 5, pp. 1-39 (2014).

(56) References Cited

OTHER PUBLICATIONS

State Intellectual Property Office of People's Republic of China, First Office Action for corresponding China Patent Application No. 201580020103.7 (dated Aug. 11, 2017).
Terves LLC, Response to First Office Action for China Patent Application No. 201580020103.7 (Official Translation dated Jul. 2, 2020).
Medlin, Dana, "Expert Report of Dana J. Medlin, Phd, PE, FASM in the Matter of *Terves LLC* v. *Yueyang Aerospace New Materials Co., Ltd*., et al.", US District Court for the Northern District Of Ohio, Eastern Division, Case No. 1:19-cv-1661 (Jul. 27, 2021.
Medlin, Dana, "Expert Rebuttal Report of Dana J. Medlin, Phd, PE, FASM", US District Court for the Northern District of Ohio, Eastern Division, Case No. 1:19-cv-1661 (Aug. 27, 2021).
Yueyang Aerospace New Materials Co, Ltd, et al., "The Ecometal Defendant's Final Invalidity, Non-Infringement, and Unenforceability Contentions", US District Court for the Northern District of Ohio, Eastern Division, Case No. 1:19-cv-1661 (Jul. 6, 2020).
Ralston and Birbilis, "Effect of Grain Size on Corrosion: A Review", Corrosion, vol. 66, No. 7, pp. 075005-01 thru 13 (2010).
Sherman, Andrew, "Declaration of Andrew J. Sherman Under 37 CFR § 1.132" in Ex Parte Reexamination of U.S. Appl. No. 90/014,795 (Jan. 14, 2021).
Swanger, Lee A., "Declaration of Lee A. Swanger, PhD, PE Under 37 CFR § 1.132" in Ex Parte Reexamination of U.S. Appl. No. 90/014,795 (Jan. 14, 2021).

| Sample | angle | loss (cc) |
|---|---|---|
| TAx-100E | 30 | 0.1301 |
| TAx-100E | 60 | 0.1483 |
| TAx-100E | 90 | 0.0442 |
| Gray Cast Iron | 30 | 0.0112 |
| Gray Cast Iron | 60 | 0.0257 |
| Gray Cast Iron | 90 | 0.0162 |
| TA-MMC170130-1 | 30 | 0.0049 |
| TA-MMC170130-1 | 60 | 0.0380 |
| TA-MMC170130-1 | 90 | 0.0323 |

Figure 8

DEGRADABLE METAL MATRIX COMPOSITE

The present invention is a continuation application of U.S. patent application Ser. No. 16/045,924 filed Jul. 26, 2018, which in turn claims priority on U.S. Provisional Application Ser. No. 62/537,707 filed Jul. 27, 2017, which are incorporated herein by reference.

TECHNICAL FIELD OF THE INVENTION

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In particular, the engineered degradable metal matrix composite of the present invention includes a core material and a degradable binder matrix, and which composite includes the following properties: A) repeating ceramic particle core material of 20-90 vol. %, B) degradable metallic binder/matrix, C) galvanically-active phases formed in situ from a melt and/or added as solid particles, D) degradation rate of 5-800 mg/cm$^2$/hr., or equivalent surface regression rates of 0.05-5 mm/hr. (and all values and ranges therebetween) in selected fluid environments such as, but not limited to, freshwater, brines and/or fracking liquids at a temperature of 35-200° C., and E) hardness exceeding 22 Rockwell C (ASTM E 18-07). The method of manufacturing the composite in accordance with the present invention includes the preparation of a plurality of ceramic particles, with or without galvanically-active materials such as, but not limited to, iron, nickel, copper, titanium, or cobalt, and infiltrating the ceramic particles with a degradable metal such as, but not limited to, magnesium, aluminum, magnesium alloy or aluminum alloy.

BACKGROUND OF THE INVENTION

The preparation of magnesium and aluminum degradable metal compositions, as well as degradable polymer compositions, has resulted in rapid commercialization of interventionless tools, including plugs, balls, valves, retainers, centralizers, and other applications. Generally, these products consist of materials that are engineered to dissolve or to corrode. Dissolving polymers and some powder metallurgy metals have been used in the oil and gas recovery industry.

While these prior art degradable systems have enjoyed success in reducing well completion costs, their ability to withstand deformation and to resist erosion in flowing fluid or to embed in steel casing are not suitable for a number of desired applications. For example, in the production of dissolving frac plugs, ceramic or steel inserts are currently used for gripping surfaces (to set the plug into the steel casing). Requirements for these grips include: a hardness higher than the steel casing; mechanical properties, including compression strength, deformation resistance (to retain a sharp edge); and fracture toughness that must be sufficient to withstand the setting operation where they are embedded slightly into the steel casing. Other applications such as 1) pump down seats currently fabricated from grey cast iron need to be milled out, and 2) frac balls or cones having very small overlaps with the seat (1/16" or less) currently have limited pressure ratings with dissolvable materials due to limited swaging or deformation resistance of current materials.

For applications such as seats and valve components and other sealing surfaces that are subjected to sand or proppant flow, existing magnesium, aluminum, or polymer alloy degradables have insufficient hardness and erosion resistance. In frac ball applications, metallic and polymer degradable balls deform, swage, and shear in such conditions, thereby limiting their pressure rating in small overlap (e.g., below 1/8" overlap) applications.

Sintered and cast products of metal matrix ceramic (MMC) plus metallic composites have been used in structural parts, wear parts, semiconductor substrates, printed circuit boards, high hardness and high precision machining materials (such as cutting tools, dies, bearings), and precision sinter molding materials, among other applications. These materials have found particular use in wear and high temperature highly loaded applications such as bearing sleeves, brake rotors, cutting tools, forming dies, and aerospace parts. Generally, these materials are selected from non-reactive components and are designed to not degrade, and the MMC and the cermets are formulated to resist all forms of corrosion/degradation, including wear and dissimilar metal corrosion.

To overcome the limitations of current degradable materials, a new material is required that has high strength, controlled degradation, and high hardness. Ideally, these high hardness degradable components and materials would also be able to be manufactured by a method that is low cost, scalable, and results in a controlled corrosion rate in a composite or alloy with similar or increased strength compared to traditional engineering alloys such as aluminum, magnesium, and iron and with hardnesses higher than cast iron. Ideally, traditional heat treatments, deformation processing and machining techniques could be used without impacting the dissolution rate and reliability of such components.

SUMMARY OF THE INVENTION

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In one non-limiting embodiment of the invention, the engineered degradable metal matrix composite includes a core material and a degradable binder matrix, and which composite includes the following properties: A) a repeating ceramic particle core material of 20-90 vol. % (and all values and arranges therebetween), B) a degradable metallic binder/matrix of 10-75 vol. % (and all values and arranges therebetween), C) galvanically-active phases formed in-situ from a melt or added as solid particles, D) a degradation rate being controlled to rates of 5-800 mg/cm$^2$/hr. (and all values and ranges therebetween), or equivalent surface regression rates of 0.05-5 mm/hr. (and all values and ranges therebetween) at a temperature of 35-200° C. (and all values and ranges therebetween) in 100-100,000 ppm (and all values and ranges therebetween) water or brines, and E) a hardness exceeding 22 (e.g., 22.01-60 Rockwell C and all values and ranges therebetween). Fluids seen in completion operations and which the composite of the present invention can be used in include 1) freshwater (generally 300-5000 ppm salt content), 2) drilling and completion brines including seawater which are generally chlorides and bromides of potassium, calcium, sodium, cesium, and zinc from about 5000 ppm to as high as 500,000 ppm or more, 3) some formates and acidic fluids, or 4) fluid produced or flowed back from the well formation which can include chlorides and carbonate salts. As can be appreciated, in some cases special fluids can be run in the well formation to cause or trigger the dissolution of the composite of the present invention, or a salt or chemical pills can be added to the fluid to cause or trigger the dissolution of the composite of the present invention. The present inventions also relates to the method of manufacturing the engineered degradable metal matrix composite of the present invention, which method includes the preparation of a plurality of ceramic particles, with or without galvanically-active materials such as, but not limited to, iron, nickel, copper, titanium, or cobalt, and infiltrating the ceramic particles with a degradable metal such as, but not limited to, magnesium or aluminum alloy.

In one non-limiting aspect of the invention, the invention relates to the formation of high hardness, wear-, deformation-, and erosion-resistant metal matrix composite materials that exhibit controlled degradation rates in aqueous media at temperatures that are at least 35° C., and typically about 35-200° C. (and all values and ranges therebetween) conditions. The ability to control the dissolution of a down hole well component in a variety of solutions is very important to the utilization of interventionless drilling, production, and completion tools such as sleeves, frac balls, hydraulic actuated tooling, scrapers, valves, screens, perforators and penetrators, knives, grips/slips, and the like. Reactive materials useful in this invention that dissolve or corrode when exposed to acid, salt, or other wellbore conditions have been proposed for some time. Incorporated by reference are U.S. Pat. Nos. 9,903,010; 9,757,796, and US Publication No. 2015/0239795 which describe techniques for creating and manufacturing dissolvable magnesium alloys through the addition of galvanically-active phases.

To obtain resistance to one type of degradation such as wear, but also to have high susceptibility to another type of corrosion such as aqueous corrosion, a composite containing two distinct phases was found to be required. One phase, being a high hardness phase, is present in large amounts (greater than 30 vol. %, and typically greater than 50 vol. %) of the composite. This high hardness phase provides resistance to wear and erosion and increases the hardness and deformation resistance of the composite. Useful deformation resistance is achieved by a second ceramic phase present in an amount of at least 10 vol. % in the composite. The deformation resistance can be enhanced by use of a higher aspect ratio ceramic phase. Useful hardness increases in the composite can be achieved with greater than 35% volumetric loading of the second ceramic phase, and can be further increased with increasing the loading. By selecting the right materials and controlling their percentages, distribution, and surface areas, novel composites can be fabricated that resist one type of degradation (namely wear or erosion) but are highly susceptible to other types of degradation (aqueous corrosion).

To achieve the desired degradation, galvanically-active phase(s) are required. This is achieved by adding a second phase either as a separate powder blended with the ceramic powder, a coating on the ceramic particles, and/or in situ by solidification or precipitation for the melt or solid solution. For example, when magnesium is selected as a degradable matrix alloy, the galvanically active phase in the magnesium matrix alloy can be formed of 1) iron and/or carbon (graphite) particle additions or coatings on ceramic particles, and/or 2) through the formation of $Mg_2M$ (where M is nickel, copper, or cobalt) -active intermetallics created during solidification from a highly alloyed melt. In terms of effectiveness for increasing corrosion rates, the following ranking can be used: Fe>Ni>Co>Cu, with carbon falling between nickel and copper depending on its structure. In another example, when aluminum or aluminum alloys are selected as the degradable matrix alloy, additions of gallium and/or indium are effective for managing corrosion, and such metals can be added as a coating on the ceramic particles, as intermetallic particles, and/or by adding as a solid solution from an aluminum alloy melt. Additional strengthening phases and solid solution material can be used to accelerate or inhibit corrosion rates. In general, aluminum and magnesium decrease corrosion rates, while zinc is neutral or can enhance corrosion rates. Corrosion rates of 0.02-5 mm/hr. (and all values and ranges therebetween) at a temperature of 35-200° C. for the composite can be achieved in freshwater or brine environments.

When the ceramic content is significant (greater than about 20 vol. %), the ceramic particles begin to block the corrosion process and inhibit the access of the aqueous solution to the degradable metal matrix. A 10-20 times decrease in degradation rates has been observed in a composite that includes 50 vol. % ceramic content. As such, the addition of ceramic content that is greater than about 20 vol. % has been found to result in a non-linear decrease in degradation rates. The decrease is generally more substantial with very fine particles of ceramic material (e.g., less than 100 micron). To compensate for a lower surface area exposed for dissolution due to a large inert loading of ceramic, a much higher dissolution rate in the matrix must be used to generate useful degradation rates. This can be accomplished by substituting more active catalysts (e.g., iron for nickel, nickel for copper), and by reducing the content of inhibiting phases (aluminum or other more cathodic metals). This may be done by moving to a ZK series alloy in magnesium from a WE or AZ series, for example. In general, the degradable matrix alloy and catalyst (galvanically-active phase) is selected to be 5-25 times as active (faster rate) than an equivalent non-composite system.

By selecting the right alloy chemistry and catalyst phase and its content (primarily exposed surface area), degradable MMCs are possible over temperatures ranging from 35-200° C., in low salinity (less than 1000 ppm dissolved solids, and typically 1-5 vol. % dissolved solids, normally KCl, NaCl), and heavy brines ($CaCl_2$, $CaBr_2$, $ZnBr_2$, carbonates, etc.). By reducing galvanically-active phases and adding inhibiting phases, materials having suitable corrosion/degradation rates in acidic media (such as 5 vol. % HCl or formic acid) can also be created.

In summary, the present invention relates to a degradable high hardness composite material that includes 1) plurality of ceramic particles having a hardness greater than 50 HRC and up to 10,000 VHN that forms 20-90 vol. % of the composite, 2) degradable alloy matrix selected from magnesium, aluminum, zinc, or their alloys that forms 10-75 vol. % of the composite, 3) plurality of degradation catalyst particles, zones, and/or regions that are galvanically-active (wherein such particles, zones, and/or regions contain one or more galvanically-active elements such as, but not limited to, iron, nickel, copper, cobalt, silver, gold, gallium, bismuth, lead, carbon or indium metals) and whose content is engineered to control degradation rates of 5-800 $mg/cm^2/hr$. (and all values and ranges therebetween), or equivalent surface regression rates of 0.05-5 mm/hr. (and all values and ranges therebetween) at a temperature of 35-200° C. (and all values and ranges therebetween) in 100-100,000 ppm (and all values and ranges therebetween) water or brines, and 4) ceramic particle content is 25-90 vol. % (and all values and ranges therebetween); to create a composite having a hardness of greater than 22 Rockwell C (ASTM E-18), and typically greater than 30 Rockwell C, and typically up to 70 Rockwell C (and all values and ranges therebetween).

The ceramic or intermetallic particles in the degradable high hardness composite material can be selected from metal carbides, borides, oxides, silicides, or nitrides such as, but not limited to, SiC, $B_4C$, $TiB_2$, TiC, $Al_2O_3$, MgO, SiC, $Si_3N_4$, $ZrO_2$, $ZrSiO_4$, $SiB_6$, SiAlON, WC, or other high hardness ceramic or intermetallic phases. The particles can be hollow or solid.

The ceramic or intermetallic particles in the degradable high hardness composite material can have a particle size of 0.1-1000 microns (and all values and ranges therebetween), and typically 5-100 microns, and may optionally have a broad or multimodal distribution of sizes to increase ceramic content.

Some or all of the ceramic or intermetallic particles in the degradable high hardness composite material can be shards, fragments, preformed or machined shapes, flakes, or other large particles with dimensions of 0.1-4 mm (and all values and ranges therebetween).

The surface coating on the ceramic or intermetallic particles can include nickel, iron, cobalt, titanium, nickel and/or copper to control dissolution and wetting as well as provide some or all of the galvanic activation. The surface coating on the ceramic or intermetallic particles can include magnesium, zinc, aluminum, tin, titanium, nickel, copper and/or other wetting agent to facilitate melt infiltration and/or particle distribution. The surface coating thickness is generally at least 60 nm and typically up to about 100 microns (and all values and ranges therebetween). The surface coating generally constitutes at least 0.1 wt. % of the coated ceramic or intermetallic particle, and typically constitutes up to 15 wt. % of the coated ceramic or intermetallic particle (and all values and ranges therebetween). The ceramic or intermetallic particles can be coated by a variety of coating techniques (e.g., chemical vapor deposition, wurster coating, physical vapor deposition, hydrometallurgy processes and other chemical or physical methods.

The particle surface of the ceramic or intermetallic particles can be modified with metal particles or other techniques to control the spacing of the ceramic particles, such as through the addition of titanium, zirconium, niobium, vanadium, and/or chromium active metal particles. Generally, these metal particles constitute about 0.1-15 wt. % (and all values and ranges therebetween) of the coated ceramic or intermetallic particles. It has been found that by coating the ceramic or intermetallic particles with such metals prior to adding the matrix metal, the metal coating facilitates in the building of a metal layer on the ceramic or intermetallic particles to create a boundary between the ceramic or intermetallic particles in the final composite, thereby effectively separating the ceramic or intermetallic particles in the final composite by at least 1.2 and typically at least 2× the coating thickness of the metal coating on the ceramic or intermetallic particles that exist on the ceramic or intermetallic particles prior to the addition of the matrix metal.

The degradable alloy matrix includes magnesium, aluminum, zinc, and their combinations and alloys which forms 10-75 vol. % of the composite, and the composite may optionally contain one or more active metals such as calcium, barium, indium, gallium, lithium, sodium, or potassium. Such active metals, when used, constitute about 0.05-10 wt. % (and all values and ranges therebetween) of the metal matrix material.

The degradation rate of the degradable high hardness composite material can be 0.01-5 mm/hr. (and all values and ranges therebetween) in fresh water or brines at a temperature of 35-200° C. (and all values and ranges therebetween).

The degradation rate of the degradable high hardness composite material can be engineered to be 0.05-5 mm/hr. (and all values and ranges therebetween) in a selected brine composition with a total dissolved solids of 300-300,000 ppm (and all values and ranges therebetween) of chloride, bromide, formate, or carbonate brines at selected temperatures of 35-200° C. (and all values and ranges therebetween).

The degradable high hardness composite material can have a compression strength of greater than 40 ksi, and typically greater than 80 ksi, and more typically greater than 100 ksi.

The degradable high hardness composite material can be fabricated by powder metallurgy, melt infiltration, squeeze casting, or other metallurgical process to create a greater than 92% pore-free structure, and typically greater than 98% pore-free structure.

The degradable high hardness composite material can be deformed and/or heat treated to develop improved mechanical properties, reduce porosity, or to form net shape or near net shape dimensions.

The degradable high hardness composite material can be useful in oil and gas or other subterranean operations, including a seat, seal, ball, sleeve, grip, slip, valve, valve component, spring, retainer, scraper, poppet, penetrator, perforator, shear, blade, insert, or other component requiring wear, erosion, or deformation resistance, edge retention, or high hardness.

The degradable high hardness composite material can be used as a portion of a component or structure, such as a surface coating or cladding, an insert, sleeve, ring, or other limited volume portion of a component or system The degradable high hardness composite material can be applied to a component surface through a cold spray, thermal spray, or plasma spray process The degradable high hardness composite material can be fabricated using pressure-assisted or pressureless infiltration of a bed of ceramic particles, wherein the galvanic catalyst, dopant, or phase is formed in situ (from solidification and precipitation of the melt), ex situ (from addition of particles or coatings in the powder bed or preform) sources, and/or formed in situ prior to or during infiltration or composite preparation.

The degradable high hardness composite material can be fabricated through powder metallurgy processes, including mixing of powders, compacting, and sintering, or alternate isostatic pressing, spark plasma sintering, powder forging, injection molding, or similar processes to produce the desired composite.

The degradable high hardness composite material can have a ceramic phase that contains flakes, platelets, whiskers, or short fibers with an aspect ratio of at least 4:1, and typically 10:1 or more.

These and other advantages of the present invention will become more apparent to those skilled in the art from a review of the figures and the description of the embodiments and claims.

BRIEF DESCRIPTION OF FIGURES

FIG. 1 illustrates a composite formed of ceramic particles 12 in a dissolvable metallic matrix 10. FIG. 2 illustrates a composite formed of ceramic particles 16 in a water degradable matrix 14 with the entire composite surrounded by a protective coating 18 (e.g., degradable polymer material, degradable metal) wherein the coating is triggered to degrade or is removed by some method. FIG. 3 illustrates a composite formed of degradable matrix 20 with ceramic particles 22 and platelet or fiber mechanically reinforcement from flakes, platelets, or fibers 24.

FIG. 5 is a magnesium-coated graphite, consolidated magnesium-germanium part, and microstructure of $Mg_2B_4C$ MMC. FIG. 6 is a magnesium-iron-germanium reactive MMC composite microstructure.

FIG. 7 also illustrates the improvement in erosion resistance of a degradable Mg—$B_4C$ composition of the present invention (Tervalloy™ MMC with 149 micron D50 ceramic particles) as compared to the baseline cast iron materials used today, and also to a non-MMC degradable magnesium alloy.

FIG. 8 is a table that illustrates impingement erosion loss of dissolvable alloys, hardened grey cast iron, and dissolvable magnesium metal matrix composite at different impingement angels.

DETAILED DESCRIPTION OF NON-LIMITING EMBODIMENTS OF THE INVENTION

Figure 1:
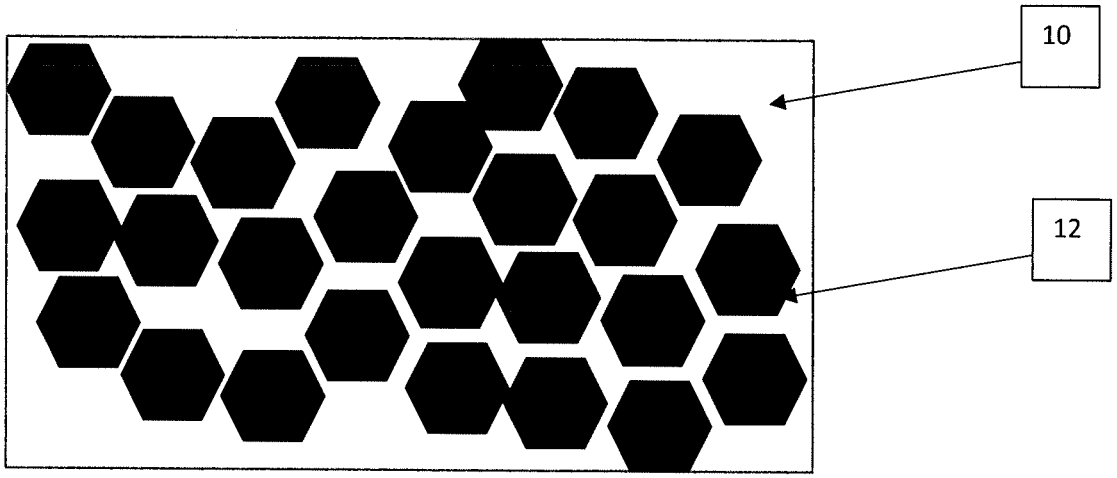
FIGS. 1-3 illustrate various non-limiting degradable metal matrix composite structures in accordance with the present invention. These figures illustrate the ceramic particles dispersed into a dissolvable metal matrix, generally at a concentration of 30-60 vol. %.

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In one non-limiting embodiment of the invention, the engineered degradable metal matrix composite includes a core material and a degradable binder matrix, and which composite includes the following properties: A) repeating ceramic particle core material of 20-90 vol. % of the composite; B) degradable metallic binder/matrix of 10-75 vol. % of the composite; C) galvanically-active phases formed in situ from a melt and/or added as solid particles that form 0.03-10 vol. % (and all values and ranges therebetween) of the composite; D) degradation rate being controlled to 0.1-5 mm/hr. in selected fluid environments including freshwater and brines at 35-200° C.; and E) hardness of the composite that exceeds 25 Rockwell C. The present inventions also relates to the method of manufacturing the engineered degradable metal matrix composite, which method includes the preparation of a plurality of ceramic particles, with or without galvanically-active materials such as, but not limited to, iron, nickel, copper, or cobalt, and infiltrating the ceramic particles with a degradable metal such as, but not limited to, magnesium or aluminum alloy. The invention also relates to the formation of high hardness, wear-, deformation-, and erosion-resistant metal matrix composite materials that exhibit controlled degradation rates in aqueous media at a temperature of at least 35° C., and typically about 35-200° C. (and all values and ranges therebetween) conditions. The ability to control the dissolution of a down hole well component in a variety of solutions is very important to the utilization of interventionless drilling, production, and completion tools such as sleeves, frac balls, hydraulic actuated tooling, scrapers, valves, screens, perforators and penetrators, knives, grips/slips, and the like.

The invention combines corrodible materials that include highly electronegative metals of magnesium, zinc, and/or aluminum, combined with a high hardness, generally inert phase such as SiC, $B_4C$, WC, $TiB_2$, $Si_3N_4$, TiC, $Al_2O_3$, $ZrO_2$, high carbon ferrochrome, $Cr_2O_3$, chrome carbide, or other high hardness ceramic, and a more electropositive, conductive phase generally selected from copper, nickel, iron, silver, lead, gallium, indium, tin, titanium, and/or carbon and their alloys or compounds. Tool steel, hard amorphous or semi-amorphous steel, and/or stellite alloy-type shards, shavings or particles can offer both galvanic and wear resistance. Other electronegative and electropositive combinations can be envisioned, but are generally less attractive due to cost or toxicity. The more electropositive phase should be able to sustain current, e.g., it should be conductive to drive the galvanic current. The ceramic phase is generally dispersed particles which are fine enough to be able to be easily removed by fluid flow and to not plug devices or form restrictions in a wellbore. It is generally accepted that particles having a size that is less than ⅛" are sufficient for this purpose, although most composites of the present invention utilize much finer particles, generally in the 100 mesh, and very often 200 or 325 mesh sizes, down to 2500 mesh (5 micron and below for increase hardness).

The ceramic or intermetallic, high hardness particles are dispersed in an electronegative metal or metal alloy matrix at concentrations at least 25 vol. %, and typically greater than 50 vol. % of the composite. Very high compressive strength and hardness can be achieved when sufficient ceramic volume has been obtained to limit the effects of the electropositive metal matrix on mechanical properties. This property can be obtained at lower ceramic content when using high aspect ratio particles, such as whiskers, flakes, platelets, or fibers, and substantial deformation resistance can be obtained with higher aspect ratio particles.

Because the generally inert ceramic phase (inert primarily due to low conductivity) inhibits corrosion rates, higher corrosion rate electronegative-electropositive alloy couples are generally used. For example, in a magnesium system, eliminating the addition of aluminum from the alloy (to make the matrix more electronegative), or shifting from copper additions to nickel or even iron (with carbon) additions can be used to increase corrosion rates. For example, using a freshwater or low temperature combination metal matrix (such as Terves FW) instead of a higher temperature brine dissolvable (such as TervAlloy™ TAx-100E and TAx-50E) can be used to sufficiently boost the corrosion rate of a 50 vol. % $B_4C$—Mg containing composite to reach 35 $mg/cm^2/hr.$ at 70-90° C. The addition of carbonyl iron particles to the magnesium alloy matrix can be used to form a useful lower temperature brine, or freshwater dissolvable metal matrix composite. Terves FW, TervAlloy™ TAx-100E and TAx-50E are magnesium or magnesium alloys with 0.05-5 wt. % nickel, and/or 0.5-10 wt. % copper additions. In one non-limiting embodiment, magnesium alloy includes over 50 wt. % magnesium and one or more metals selected from the group consisting of aluminum, boron, bismuth, zinc, zirconium, and manganese, and optionally 0.05-35 wt. % nickel, copper and/or cobalt. In another non-limiting embodiment, the magnesium alloy includes over 50 wt. % magnesium and one or more metals selected from the group consisting of aluminum in an amount of about 0.5-10 wt. %, zinc in amount of about 0.1-6 wt. %, zirconium in an amount of about 0.01-3 wt. %, manganese in an amount of about 0.15-2 wt. %; boron in amount of about 0.0002-0.04 wt. %, and bismuth in amount of about 0.4-0.7 wt. %, and optionally 0.05-35 wt. % nickel, copper and/or cobalt. In another non-limiting embodiment, the magnesium alloy includes over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. %; boron in amount of about 0.0002-0.04 wt. %, and bismuth in amount of about 0.4-0.7 wt. %, and optionally 0.05-35 wt. % nickel, copper and/or cobalt. In another non-limiting embodiment, the magnesium alloy comprises at least 85 wt. % magnesium; one or more metals selected from the group consisting of 0.5-10 wt. % aluminum, 0.05-6 wt. % zinc, 0.01-3 wt. % zirconium, and 0.15-2 wt. % manganese; and optionally about 0.05-45 wt. % of a secondary metal selected from the group consisting of copper, nickel, cobalt, titanium and iron. In another non-limiting embodiment, the magnesium alloy composite comprises 60-95 wt. % magnesium; 0.01-1 wt. % zirconium; and optionally about 0.05-45 wt. % copper, nickel, cobalt, titanium and/or iron. In another non-limiting embodiment, the magnesium alloy comprises 60-95 wt. % magnesium; 0.5-10 wt. % aluminum; 0.05-6 wt. % zinc; 0.15-2 wt. % manganese; and optionally about 0.05-45 wt. % of copper, nickel, cobalt, titanium and/or iron. In another non-limiting embodiment, the magnesium alloy comprising 60-95 wt. % magnesium; 0.05-6 wt. % zinc; 0.01-1 wt. % zirconium; and optionally about 0.05-45 wt. % of copper, nickel, cobalt, titanium and/or iron. In another non-limiting embodiment, the magnesium alloy comprises over 50 wt. % magnesium; one or more metals selected from the group consisting of 0.5-10 wt. % aluminum, 0.1-2 wt. % zinc, 0.01-1 wt. % zirconium, and 0.15-2 wt. % manganese; and optionally about 0.05-45 wt. % of copper, nickel and/or cobalt. In another non-limiting embodiment, the magnesium alloy comprises over 50 wt. % magnesium; one or more metals selected from the group consisting of 0.1-3 wt. % zinc, 0.01-1 wt. % zirconium, 0.05-1 wt. % manganese, 0.0002-0.04 wt. % boron and 0.4-0.7 wt. % bismuth; and optionally about 0.05-45 wt. % of copper, nickel, and/or cobalt. In another non-limiting embodiment, the magnesium alloy comprises 60-95 wt. % magnesium and 0.01-1 wt. % zirconium. In another non-limiting embodiment, the magnesium alloy comprises over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. %, boron in amount of about 0.0002-0.04 wt. %, and bismuth in amount of about 0.4-0.7 wt. %.

Figure 4:
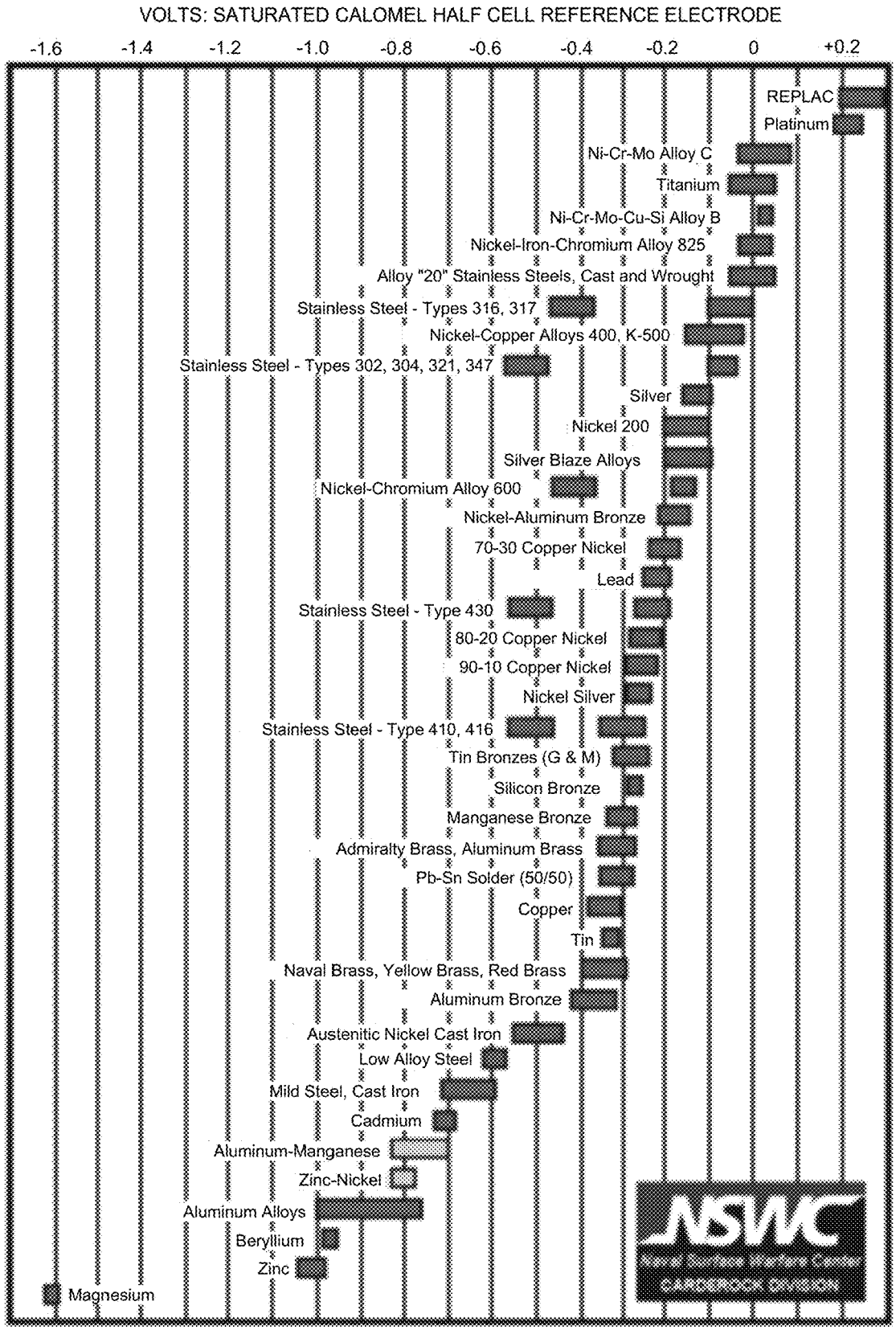
FIG. 4 is a chart illustrating the galvanic series showing electronegative materials. Magnesium is a very electronegative material and undergoes active corrosion when coupled with a variety of metals. Particularly effective are iron, nickel, copper, and cobalt, as well as $Fe_3Al$ since they do not form insulating oxides under typical conditions and, as such, maintain electrical connectivity with the fluid. Dissolution rates are controlled by the amount and size of these additives, driven by the electrically connected surface area of the positive and negative metals in the galvanic series.

The electropositive driving phase can be added by adding soluble or insoluble electropositive particles to the ceramic powder prior to melt infiltration or mixing into a melt by adding the electropositive material as a coating or cladding to the inert ceramic phase, or by adding as an alloying element that forms a fully liquid phase with the electropositive metal or alloy. In the liquid phase, generally an electropositive metal that forms a eutectic with the electronegative metal and an intermetallic of the electropositive metal can be used. Non-limiting examples of such coatings or claddings are Mg—Ni, Mg—Cu, Mg—Co, and Mg—Ag. FIG. 4 is a chart illustrating the galvanic series showing electronegative materials (magnesium through cadmium, electronegative being more electronegative than steel), and electropositive metals (steel through carbon).

The electropositive driving phase can also be added to electropositive metal powders, along with the ceramic phase, and the dissolvable MMC fabricated from powder metallurgy or spray consolidation techniques such as press and sinter, hot isostatic pressing, spark plasma sintering, powder sinter-forging, direct powder extrusion, thermal spray, cold spray, plasma spray, or other powder consolidation techniques.

For melt infiltration of a ceramic preform or powder bed, techniques that can be used include pressureless infiltration (when the ceramic and electronegative metal wet each other, or when the ceramic has been coated with a wetting phase such as a eutectic forming or other easily wet metal), or pressure-assisted infiltration technique such as squeeze casting, high pressure die casting (into the ceramic preform), vacuum casting, or pressure-assisted casting techniques, among others. Particularly at lower ceramic volumes (25-50 vol. %), the particles can be stir-cast, thixocast, or slurry cast by mixing the ceramic (and electropositive material, if in powder form) and formed in the liquid plus ceramic or semi-solid state. Net shape or near net shape fabrication techniques are preferred due to machining cost of precision grinding of the high hardness materials. Active wetting metals such as titanium, zirconium, vanadium, niobium, silicon, boron, and palladium can be added to the melt system to enhance wetting. Surface wetting coatings, often eutectic liquid formers such as niobium, zirconium, magnesium, aluminum, silicon, and/or bismuth can provide strong wetting ability to enhance pressureless infiltration.

After consolidation, the compact can be further formed by forging, extrusion, or rolling. The compact can also be taken back to an elevated temperature, normally in the semi-solid region between the electropositive alloy liquidus and solidus, and formed using closed die forming, squeeze casting, thixocasting, or other semi-solid forming technique.

The cast or formed part can be machined to close tolerances using grinding or electrode discharge machining (EDM). Diamond, CBN, and other high hardness tools can also be used.

The degradable metal matrix composite can be applied as a coating, such as by cold spray, to a separate part, to impart wear-, erosion-, or deformation-resistance, or to slow initial dissolution rates to give added life. A higher degradation rate core is generally desired. In one embodiment, the MMC can be created by surface alloying the higher degradation rate, or lower hardness core, with the ceramic phase by such techniques as friction stir surfacing, supersonic particle spray, or reactive heat treatments (such as boronizing). Other routes to a dual structured component include overcasting or overmolding, or physical assembly with or without an adhesive or bonding step such as forging, hot pressing, friction welding, or use of adhesives.

After machining, parts may be further coated or modified to control initiation of dissolution or to further increase hardness or ceramic content. Techniques such as cold spray, thermal spray, friction surfacing, powder coating, anodizing, painting, dip coating, e-coating, etc. may be used to add a surface coating or otherwise modify the surface.

The degradable MMCs of the present invention are particularly useful in the construction of downhole tools for oil and gas, geothermal, and in situ resource extraction applications. The higher hardness enables tools such as reamers, valve seats, ball seats, and grips to be engineered to be fully degradable, eliminating debris as well as the need to retrieve or drill-out the tools. The degradable MMC is a useful, degradable substitute for hardened cast iron in applications such as plug seats and gripping devices for bridge and frac plugs. The degradable MMC is also useful for the design and production of cement plugs, reamers, scrapers, and other devices.

The deformation resistance of the degradable MMCs allows the construction of higher pressure rating valve and plug systems than non-MMC degradable products. For example, a degradable MMC frac ball can withstand 15,000 psi across a 1/16" seat overlap compared to less than 7,000 psi for a conventional degradable magnesium alloy or polymer ball.

Figure 2:
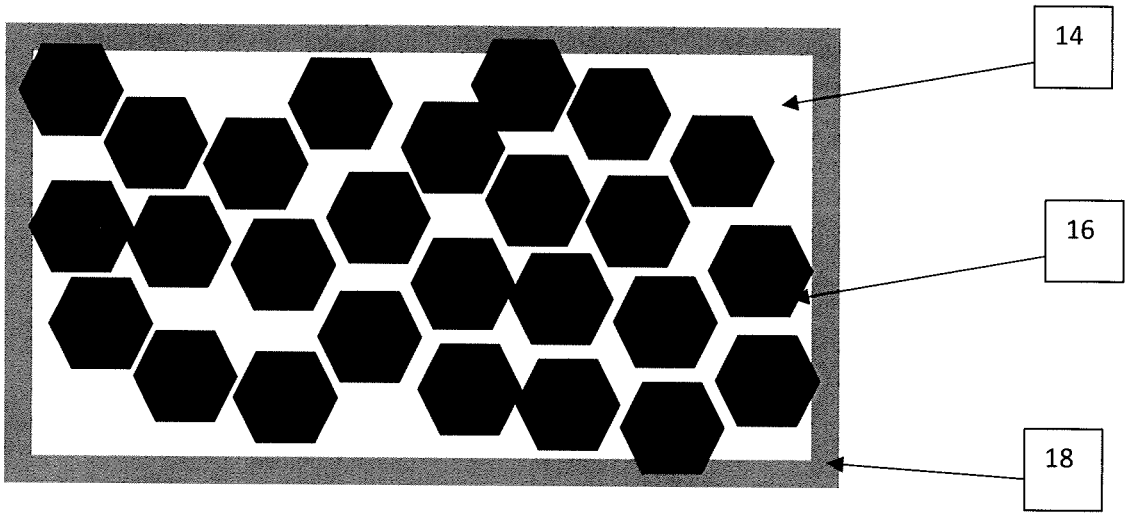
Figure 3:
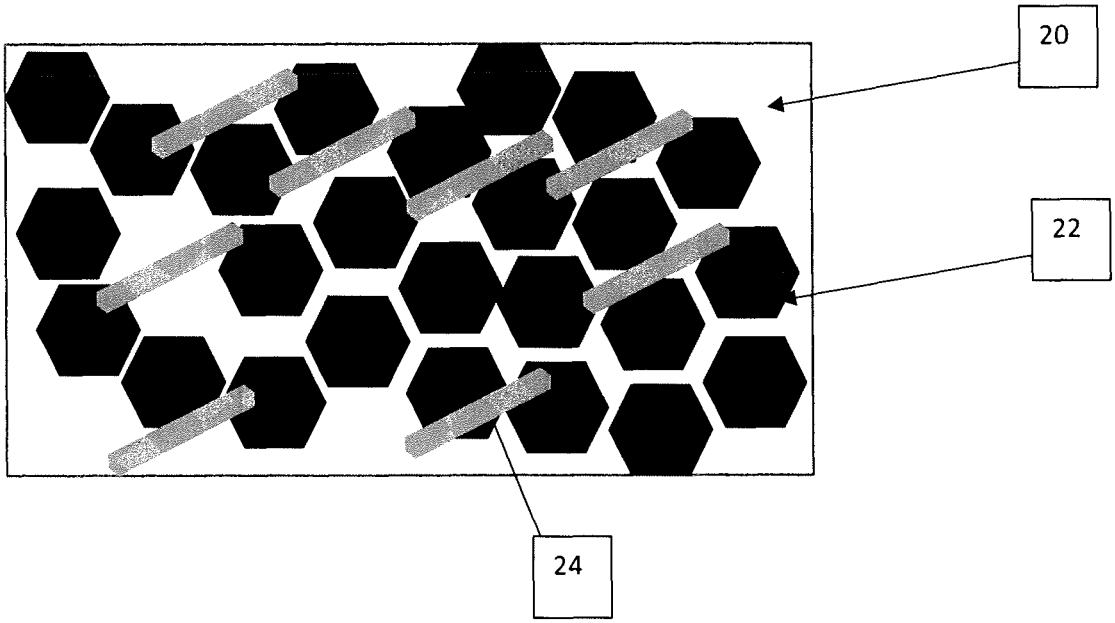

FIGS. 1-3 illustrate various degradable metal matrix composite structures in accordance with the present invention. FIGS. 1-3 illustrate a composite formed of ceramic particles 12 in a dissolvable metallic matrix 10.

The composite material is formed by 1) providing ceramic particles, 2) providing a galvanically-active material such as iron, nickel, copper, titanium, and/or cobalt, 3) combining the ceramic particles and galvanically-active material with molten matrix material such as molten magnesium, molten aluminum, molten magnesium alloy or molten aluminum alloy, and 4) cooling the mixture to form the composite material. The cooled and solid dissolvable metallic matrix generally includes over 50 wt. % magnesium or aluminum. The ceramic material is generally coated with the galvanically-active material prior to adding the motel matrix material; however, this is not required.

The galvanically-active material coating on the ceramic material, when precoated, can be applied by any number of techniques (e.g., vapor deposition, dipping in molten metal, spray coating, dry coated and then heated, sintering, melt coating technique, etc.). Generally, each of the coated ceramic particles are formed of 30-98 wt. % ceramic material (and all values and ranges therebetween), and typically greater than 50 wt. % ceramic material. The thickness of the galvanically-active material coating is generally less than 1 mm, and typically less than 0.5 mm.

After the composite is formed, the ceramic material constitutes about 10-85 wt. % (and all values and arranges therebetween) of the composite, the galvanically-active material constitutes about 0.5-30 wt. % (and all values and arranges therebetween) of the composite, and the molten matrix material constitutes about 10-85 wt. % (and all values and arranges therebetween) of the composite.

The dissolution rate of the composite is at least 5-800 $mg/cm^2/hr.$, or equivalent surface regression rates of 0.05-5 mm/hr. at a temperature of 35-200° C. in 100-100,000 ppm water or brines, and typically at least 45 $mg/cm^2/hr.$ in 3 wt. % KCl water mixture at 90° C., more typically up to 325 $mg/cm^2/hr.$ in 3 wt. % KCl water mixture at 90° C.

FIG. 2 illustrates the composite surrounded by a protective coating 18 (e.g., degradable polymer material, degradable metal). The protective coating can be formulated to dissolve or degrade when exposed to one or more activation or trigger conditions such as, but not limited to, temperature, electromagnetic waves, sound waves, certain chemicals, vibrations, salt content, electrolyte content, magnetism, pressure, electricity, and/or pH. Once the protective coating has sufficiently dissolved or degraded, the composite is then exposed to the surrounding fluid, thus causing the composite to dissolve, corrode, etc. when exposed to certain surrounding conditions. The protective coating can be formed of one or more metal and/or polymer layers. Non-limiting polymer protective coatings that can be used include ethylene-α-olefin copolymer; linear styrene-isoprene-styrene copolymer; ethylene-butadiene copolymer; styrene-butadiene-styrene copolymer; copolymer having styrene endblocks and ethylene-butadiene or ethylene-butene midblocks; copolymer of ethylene and alpha olefin; ethylene-octene copolymer; ethylene-hexene copolymer; ethylene-butene copolymer; ethylene-pentene copolymer; ethylene-butene copolymer; polyvinyl alcohol (PVA); silicone, and/or polyvinyl butyral (PVB). The thickness of the protective coating is generally less than 3 mm, and more typically about 0.0001-1 mm.

FIG. 3 illustrates a composite formed of degradable matrix 20 with ceramic particles 22 and platelet or fiber mechanically-reinforced flakes, platelets, or fibers 24. The platelets or fibers typically have an aspect ratio of at least 4:1, and typically 10:1 or more. The length of the platelets or fibers is generally less than 3 mm, and typically less than 2 mm. The platelets or fibers, when used, are generally formed of boron carbide silicon carbide, and/or graphite; however, other materials can be used.

EXAMPLES

In one embodiment, the reactivity of an electrolytically activated reactive composite of magnesium or zinc and iron with ceramic reinforcements is controlled to produce a dissolution rate of 1-10 mm/day (and all values and ranges therebetween), or 0.5-800 $mg/cm^2/hr.$ (and all values and ranges therebetween) (depending on density) by controlling the relative phase amounts and interfacial surface area of the two galvanically-active phases. In one example, a mechanical mixture of iron or graphite and magnesium is prepared by mechanical milling of magnesium or magnesium alloy powder and 40 vol. % of 30-200 micron iron graphite (and all values and ranges therebetween) graphite or 10 wt. % nickel-coated graphite particles, followed by consolidation using spark plasma sintering or powder forging at a temperature below the magnesium or zinc melting point. The resultant structure has an accelerated rate of reaction due to the high exposed surface area of the iron or graphite cathode phase, but low relative area of the anodic (zinc or magnesium) reactive binder.

Figure 5:
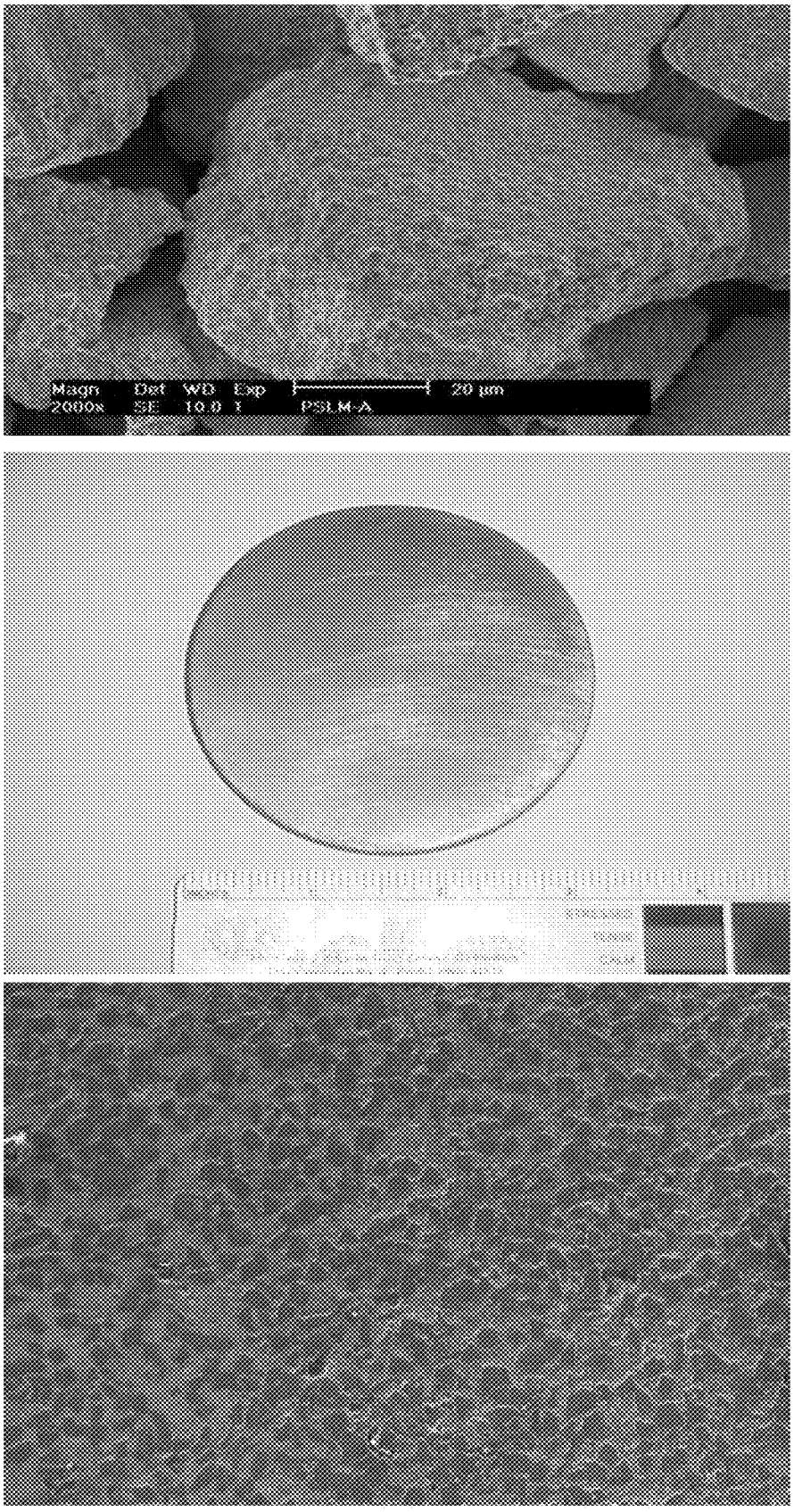
FIGS. 5 and 6 illustrate a representative microstructure for a magnesium-graphite composite that is galvanically active and could be used as a low friction or deformation-resistant structure, but is not generally effective for wear resistance.
Figure 6:
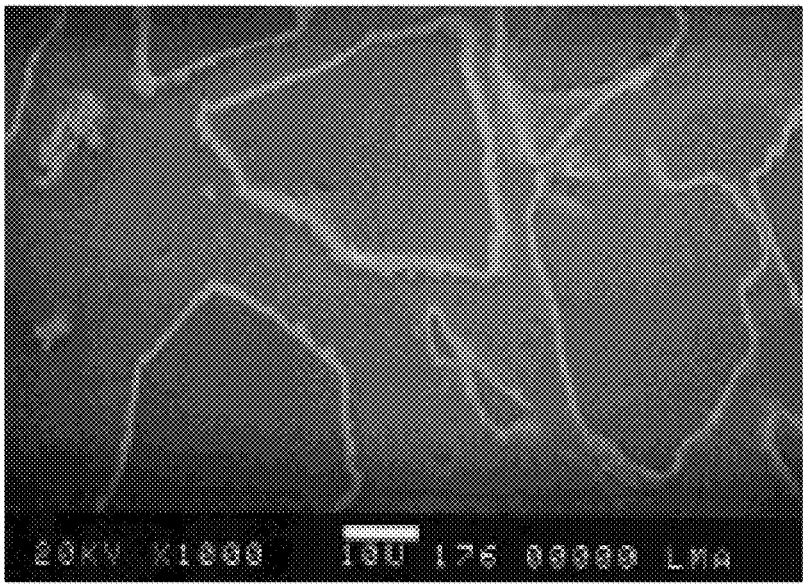
Figure 7:
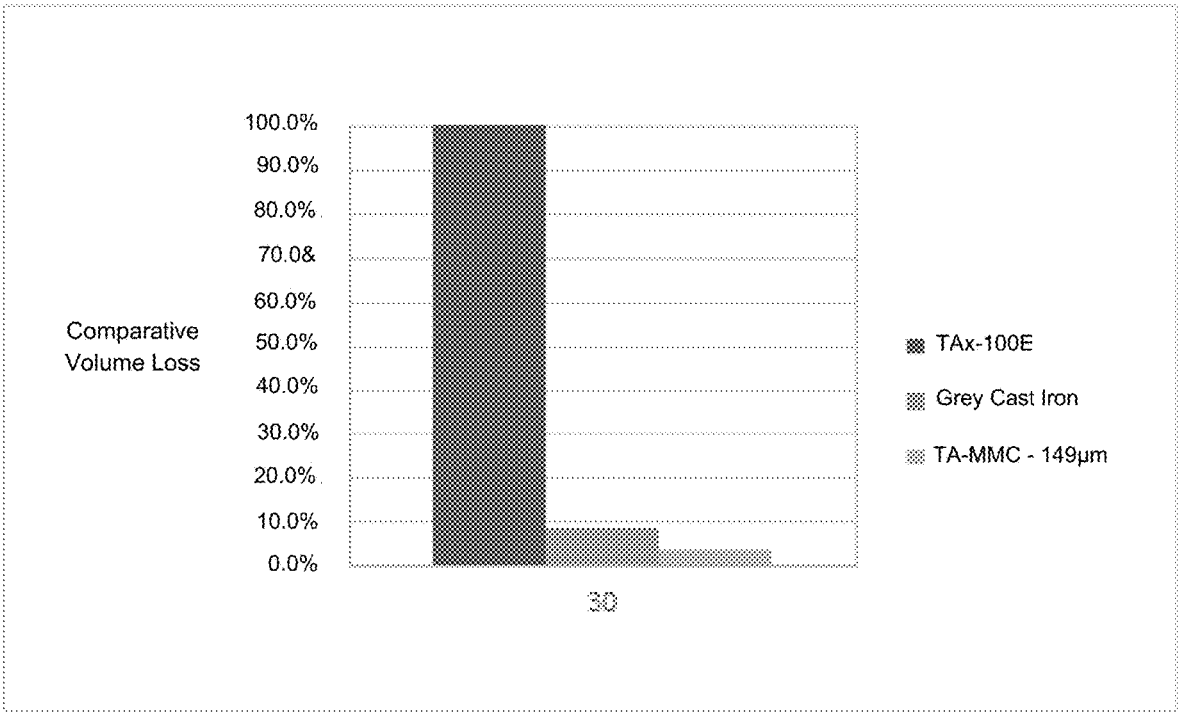
FIG. 7 illustrates the comparative impingement loss at 30° impact angle of a typical seat versus material.

The degradable MMC can be used for powder metallurgical processing. FIGS. 5 and 6 illustrate a representative microstructure for a magnesium-graphite composite.

In general, larger ceramic particles, typically above 40 mesh, including flake, impart great impingement erosion resistance at higher angels, while smaller particles, typically below 200 mesh, provide higher sliding wear resistance. Larger particles can also facilitate gripping (in frac plug grips/slips, to facilitate locking a device to a mating surface), such as when mm-sized crushed carbides are added to a dissolvable matrix. Such embedded metal matrix composites can also be used in reamer-type applications as abrasives, such as by adding larger chunks or even preformed shapes, such as crushed, machined, or formed carbides or tool steel discreet elements.

Example 1

Boron carbide powder with an average particle size of 325 mesh is surface modified by the addition of zinc by blending 200 grams of $B_4C$ powder with 15 grams of zinc powder and heated in a sealed, evacuated container to 700° C. to distribute the zinc to the particle surfaces. The zinc-coated $B_4C$ powder is placed into a graphite crucible and heated to 500° C. with an inert gas cover. In a separate steel crucible, 500 grams of Terves FW low temperature dissolvable degradable magnesium alloy is melted to a temperature of 720° C. The degradable magnesium alloy is poured into the 8-inch deep graphite crucible containing the zinc-coated $B_4C$ particles sufficient to cover the particles by at least two inches and allowed to solidify.

The material had a hardness 52 Rockwell C, and a measured dissolution rate of 35 mg/cm$^2$/hr. in 3 vol. % KCl at 90° C.

Example 2

300 g of 600 mesh boron carbide powder was placed to a depth of 4"×2" diameter by ten-inch deep graphite crucible containing a two inch layer of ¼" steel balls (600 g of steel) covered by a 325 mesh steel screen and heated to 500° C. under inert gas. The graphite crucible was heated inside of a steel tube, which was heated with the crucible. Five pounds of Terves FW degradable magnesium alloy were melted in a steel crucible to a temperature of 730° C. and poured into the graphite crucible sufficient to cover the $B_4C$ and steel balls to reach within two inches of the top of the graphite crucible. The crucible was removed from the furnace and transferred to a 12-ton carver press, where a die was rammed into the crucible forcing the magnesium into and through the powder bed. The crucible was removed from the press and allowed to cool.

The MMC section was separated from the non-MMC material and showed a dissolution rate of 45 gm/cm$^2$/hr. at 90° C. in 3 vol. % KCl solution. The measured hardness was 32 Rockwell C.

Example 3

125 grams of 325 mesh $B_4C$ powder was blended with 4 grams of 100 mesh titanium powder and sintered at 500° C. to form a rigid preform. A 500 gram ingot of TAx-50E dissolvable metal alloy was placed on top of the preform in a graphite crucible. The crucible was placed in the inert gas furnace and heated to 850° C. for 90 minutes to allow for infiltration of the preform. The infiltrated preform had a hardness of 24 Rockwell C.

Example 4

Degradable MMC from Example 3 was machined into a frac ball. A 3" ball (3.000+/−0.002), when tested against a cast iron seat with a 45° seat angle and inner diameter of 2.896", was shown to hold greater than 15,000 psig pressure at room temperature. The degradable magnesium frac ball was machined from a high dissolution rate dissolving alloy having a dissolution rate of greater than 100 mg/cm$^2$/hr. at 90° C. The frac ball was undermachined by 0.010", to 2.980+/−0.002, and the degradable MMC was applied using cold spray application from a powder generated by ball milling 400 grams of standard degradable alloy machine chips with 600 grams 325 mesh of $B_4C$ powder using a centerline Windsor SST cold spray system and nitrogen gas as the carrier gas. The ball was then machined to 3"+/−0.002". The ball held >10,000 psig against a 45° cast iron seat at 2.875" inner diameter. The frac ball was designed to give two hours of operating time, before dissolving rapidly in less than 48 hours at 90° C. in 3% KCl brine solution.

Example 5

Degradable MMC from Example 3 was machined into a frac ball except that TAx-100E was used instead of TAx-50E. The TAx-100E included trace amounts of iron to form a composite having a hardness of 74HRB and a dissolution rate of 34 mg/cm$^2$/hr. in 3% vol. % KCl at 90° C. during a six-hour test. 125 grams of 325 mesh $B_4C$ powder was blended with 4 grams of 100 mesh titanium powder and sintered at 500° C. to form a rigid preform. A 500 gram ingot of TAx-100E with 0.1% iron was placed on top of the preform in a steel crucible. The crucible was placed in the inert gas furnace and heated to 850° C. for 90 minutes to allow for infiltration of the preform. The infiltrated preform had a hardness of 74HRB and a dissolution rate of 34 mg/cm$^2$/hr. in 3% KCl at 90° C. during six hours of brine exposure.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A method for forming a degradable composite, said method comprises:

a. providing ceramic particles, a plurality of said ceramic particles having a hardness of greater than 50 HRC;

b. providing one or more galvanically-active elements selected from the group consisting of iron, carbon, nickel, copper, cobalt, gallium, indium, and titanium;

c. combining ceramic particles and said one or more galvanically-active elements with a degradable metal material, said degradable metal material selected from magnesium, magnesium alloy including greater than 50 wt. % magnesium, and an aluminum alloy;

d. dispersing said plurality of ceramic particles and said one or more galvanically-active elements in said degradable metal material while said degradable metal material is in a molten state to form a mixture; and, e. cooling said mixture to form said degradable composite, said degradable composite having a degradation rate of at least 5 mg/cm$^2$/hr. in freshwater or brine at a temperature of at least 90° C.

2. The method as defined in claim 1, wherein said degradable composite has a hardness of greater than 22 Rockwell C.

3. The method as defined in claim 1, wherein said degradable composite includes at least 10 vol. % degradable metal material, at least 0.03 vol. % galvanically-active elements, and at least 10 vol. % ceramic particles.

4. The method as defined in claim 1, wherein said degradable composite includes one or more metals selected from the group constating of calcium, barium, lithium, sodium, potassium, silver, gold, bismuth, lead, and palladium.

5. The method as defined in claim 1, wherein said ceramic particles include one or more materials selected from the group consisting of $B_4C$, $TiB_2$, TiC, $Al_2O_3$, MgO, SiC, $Si_3N_4$, $ZrO_2$, $ZrSiO_4$, $SiB_6$, SiAlON, WC, carbon ferrochrome, $Cr_2O_3$, and chrome carbide.

6. The method as defined in claim 1, wherein a plurality of said ceramic particles are surface coated with said one or more galvanically-active elements to form a coating on said ceramic particles prior to being combined with said degradable metal material.

7. The method as defined in claim 1, wherein said coating on said ceramic particles has a thickness of 60 nm to 100 microns.

8. The method as defined in claim 1, wherein said degradable metal material is a magnesium alloy, said magnesium alloy including one or more metal additives selected from the group consisting of nickel, copper, aluminum, boron, bismuth, zinc, zirconium, cobalt, manganese, titanium, and iron.

9. The method as defined in claim 1, wherein said method further includes the step of coating said degradable composite with a protective coating, said protective coating having a thickness less than 3 mm, said protective coating including a polymer layer.

10. The method as defined in claim 1, wherein said method further includes the step of adding flakes, fibers, or platelets to said mixture of said molten degradable metal matrix, said ceramic or intermetallic particles, and said galvanically-active elements, said flakes, fibers, or platelets having an aspect ratio of at least 4:1, said flakes, fibers, or platelets having a length of up to 4 mm, said flakes, fibers, or platelets including one or more materials selected from the group consisting of boron carbide, silicon carbide, and graphite.

11. The method as defined in claim 9, wherein said method further includes the step of forming said degradable composite to partially or fully form a structure selected from the group consisting of a seat, a seal, a ball, a frac ball, a cone, a wedge, an insert for a slip, a sleeve, a valve, a frac seat, a grip, a slip, a valve component, a spring, a retainer, a scraper, a poppet, a penetrator, a perforator, a shear, a blade, and an insert.

12. The method as defined in claim 9, wherein said ceramic particles have a particle size of 0.1 microns to 1000 microns.

13. The method as defined in claim 9, wherein said degradable composite has a structure that is greater than 92% pore-free.

* * * * *